US008845493B2

(12) United States Patent
Watterson et al.

(10) Patent No.: US 8,845,493 B2
(45) Date of Patent: Sep. 30, 2014

(54) SYSTEM AND METHOD FOR EXERCISING

(75) Inventors: Scott Watterson, Logan, UT (US); William Dalebout, North Logan, UT (US); Dale Buchanan, Nibley, UT (US)

(73) Assignee: ICON IP, Inc., Logan, UT (US)

( * ) Notice: Subject to any disclaimer, the term of this patent is extended or adjusted under 35 U.S.C. 154(b) by 0 days.

(21) Appl. No.: 13/044,801

(22) Filed: Mar. 10, 2011

(65) Prior Publication Data

US 2011/0172059 A1 Jul. 14, 2011

Related U.S. Application Data

(63) Continuation-in-part of application No. 12/413,330, filed on Mar. 27, 2009, now Pat. No. 8,251,874.

(60) Provisional application No. 61/429,091, filed on Dec. 31, 2010.

(51) Int. Cl.

| | |
|---|---|
| ***A63B 24/00*** | (2006.01) |
| ***A63B 21/005*** | (2006.01) |
| ***A63B 22/06*** | (2006.01) |
| ***A63B 69/16*** | (2006.01) |
| ***A63B 71/06*** | (2006.01) |
| *A63B 21/22* | (2006.01) |
| *A63B 22/02* | (2006.01) |
| *A63B 22/00* | (2006.01) |

(52) U.S. Cl.

CPC ..... *A63B 24/0087* (2013.01); *A63B 21/225* (2013.01); *A63B 24/0062* (2013.01); *A63B 22/0242* (2013.01); *A63B 2220/30* (2013.01); *A63B 22/0023* (2013.01); *A63B 24/0084* (2013.01); *A63B 2220/20* (2013.01); *A63B 2230/06* (2013.01); *A63B 2024/009* (2013.01); *A63B 71/0622* (2013.01); *A63B 2220/78* (2013.01); *A63B 2230/75* (2013.01); *A63B 22/02* (2013.01); *A63B 2220/73* (2013.01); *A63B 2071/0691* (2013.01); *A63B 2230/30* (2013.01); *A63B 2071/0644* (2013.01); *A63B 22/0605* (2013.01); *A63B 2225/20* (2013.01)

USPC ..... 482/4; 482/1; 482/5; 482/57

(58) Field of Classification Search

USPC ..... 482/1, 4, 5

See application file for complete search history.

(56) References Cited

U.S. PATENT DOCUMENTS 5,035,418 A * 7/1991 Harabayashi ..... 482/62
5,240,417 A * 8/1993 Smithson et al. ..... 434/61

(Continued)

OTHER PUBLICATIONS eSPINNER®,http://www.startrac.com/us-en/cardio/detail.aspx?id=228, Feb. 23, 2011 (5pages).

(Continued)

*Primary Examiner* — Loan H Thanh
*Assistant Examiner* — Shila Jalalzadeh Abyan
(74) *Attorney, Agent, or Firm* — Holland & Hart, LLP

(57) ABSTRACT

Embodiments relate to exercise systems, and more particularly to exercise cycles and systems for generating exercise programs simulating real-world terrain. In accordance with at least some aspects, a stationary exercise cycle includes an incline mechanism adjusting the vertical and/or lateral incline of the stationary exercise cycle. The incline mechanism may respond to control signals that change vertical incline to simulate an ascent or descent of a hill, or a lateral incline to simulate a turn. A communication system may provide exercise programs to the exercise cycle by operating in connection with third party providers of topographical, map, or other information. Such information can be used to automatically determine corresponding incline or resistance changes, as well as visual information for an exercise program.

20 Claims, 11 Drawing Sheets

(56) References Cited

U.S. PATENT DOCUMENTS

| | | | | |
|---|---|---|---|---|
| 6,126,577 | A * | 10/2000 | Chang | 482/57 |
| 6,287,239 | B1 | 9/2001 | Hernandez | |
| 6,312,363 | B1 | 11/2001 | Watterson et al. | |
| 6,450,922 | B1 | 9/2002 | Henderson | |
| 6,458,060 | B1 | 10/2002 | Watterson et al. | |
| 6,645,125 | B1 * | 11/2003 | Stearns et al. | 482/52 |
| 6,648,802 | B2 * | 11/2003 | Ware | 482/57 |
| 6,997,852 | B2 | 2/2006 | Watterson et al. | |
| 7,060,006 | B1 | 6/2006 | Watterson et al. | |
| 7,601,097 | B2 * | 10/2009 | Miyamaru et al. | 482/5 |
| 7,766,798 | B2 * | 8/2010 | Hamilton | 482/61 |
| 7,833,129 | B2 * | 11/2010 | Badarneh et al. | 482/5 |
| 2002/0055422 | A1 * | 5/2002 | Airmet et al. | 482/61 |
| 2006/0003872 | A1 * | 1/2006 | Chiles et al. | 482/57 |
| 2006/0094569 | A1 * | 5/2006 | Day | 482/57 |
| 2006/0247095 | A1 * | 11/2006 | Rummerfield | 482/1 |
| 2007/0004565 | A1 * | 1/2007 | Gebhardt | 482/61 |
| 2007/0265138 | A1 | 11/2007 | Ashby | |
| 2009/0011907 | A1 * | 1/2009 | Radow et al. | 482/57 |
| 2009/0118099 | A1 * | 5/2009 | Fisher et al. | 482/5 |
| 2009/0209393 | A1 * | 8/2009 | Crater et al. | 482/9 |
| 2010/0035726 | A1 * | 2/2010 | Fisher et al. | 482/8 |
| 2010/0113223 | A1 * | 5/2010 | Chiles et al. | 482/5 |

OTHER PUBLICATIONS

Kettler W Orld Tours—Training,http://www.kettlerworldtours.de/en/main/, Feb. 23, 2011 (17pages).

* cited by examiner

SYSTEM AND METHOD FOR EXERCISING

CROSS-REFERENCE TO RELATED APPLICATIONS

This application is a continuation in part of U.S. patent application Ser. No. 12/413,330, filed on Mar. 27, 2009 and entitled "EXERCISE SYSTEMS FOR SIMULATING REAL WORLD TERRAIN," now U.S. Pat. No. 8,251,874, issued on Aug. 22, 2012. This application also claims priority to, and the benefit of, U.S. Patent Application Ser. No. 61/429,091, filed on Dec. 31, 2010, and entitled "SYSTEM AND METHOD FOR EXERCISING." The foregoing applications are expressly incorporated herein by this reference in their entireties.

TECHNICAL FIELD

The present disclosure relates generally to systems and methods for exercising. More particularly, the present disclosure relates to exercise cycle systems and methods for selective adjustment to simulate movement along real world terrain.

BACKGROUND

While exercise equipment is being purchased in record quantities, it remains a challenge to motivate a consumer to use the exercise device on a consistent and ongoing basis. This lack of motivation often is a result of the repetitive nature of the exercises and exercise routines that a user can perform on a specific exercise device as well as the versatility of the exercise devices.

With respect to a typical stationary exercise cycle, for example, a user sits on a seat, holds onto a set of handles, and pedals with his or her feet. In order to provide variety during the exercise routine, the user can increase or decrease his or her pedaling rate at various times during the exercise routine. This can be done by increasing or decreasing the amount of effort the user uses to pedal or by increasing or decreasing the pedaling resistance provided by the exercise cycle. Additionally, many stationary exercise cycles are pre-programmed with one or more exercise routines that automatically adjust the pedaling resistance at various time intervals during the exercise routine. Adjusting the pedaling rate and/or the pedaling resistance can allow a user to achieve a workout suitable for the user's fitness level and goals. Adjusting the pedaling rate and/or the pedaling resistance is, however, often insufficient to maintain a user's motivation to consistently use the stationary exercise cycle.

Another factor that may contribute to the lack of motivation to use an exercise bicycle is the lack of visual or other type of stimulation provided to the user while using the exercise device. For instance, while a cyclist may go outdoors and choose between different routes of varied intensity and with constantly changing surroundings, users of exercise bicycles often become bored because their surroundings do not change during an exercise routine. Rather, their surroundings (e.g., the room in which the exercise bicycle is located) are generally the same each time the user exercises and throughout each exercise session. This boredom can discourage the user from regularly using the exercise cycle, or cause the user not to work as hard during the exercise session.

Devices that have been proposed to combat a lack of stimulation are found in United States Patent Publication No. 20070265138, which describes exercise devices, including exercise cycles, that are equipped with a display and speakers for providing visual and audio stimulation and motivation to the user of the device. For example, the display provides a graphical image indicating the changes that may be made by the exercise device, along with the total distance the user moves during the exercise. For instance, the display of a stationary exercise cycle may depict a series of hills that are related to the pedaling resistance of the exercise cycle. Additionally, a personal trainer's voice may be used during the program to alert the consumer to changes to resistance, or to otherwise encourage the consumer during the ride.

In addition, other exercise cycles or other devices include those in U.S. Pat. No. 6,287,239, U.S. Pat. No. 6,997,852, U.S. Pat. No. 6,458,060, U.S. Pat. No. 7,060,006, and U.S. Pat. No. 6,312,363, as well as exercise cycles sold under the trade name "ESPINNER," and software sold under the trade name "KETTLER WORLD TOURS."

SUMMARY OF THE DISCLOSURE

In one aspect of the present disclosure, an exercise cycle is provided, and may be used to simulate real-world terrain. The exercise cycle may include a bicycle frame, a pedal assembly, and an incline mechanism configured to change a vertical pitch of at least a portion of the bicycle frame relative to a support surface.

In accordance with an aspect that may be combined with any one or more other aspects disclosed herein, an exercise bicycle includes a resistance assembly adapted to apply resistance to a rotation of the pedal assembly.

In accordance with an aspect that may be combined with any one or more other aspects disclosed herein, a resistance assembly applies resistance directly or indirectly to a pedal assembly.

In accordance with an aspect that may be combined with any one or more other aspects disclosed herein, a resistance assembly applies resistance directly to a flywheel associated with a pedal assembly.

In accordance with an aspect that may be combined with any one or more other aspects disclosed herein, an exercise cycle includes a communication interface.

In accordance with an aspect that may be combined with any one or more other aspects disclosed herein, a communication interface is configured to use and/or receive exercise programming that can automatically control at least one of a resistance assembly or incline mechanism.

In accordance with an aspect that may be combined with any one or more other aspects disclosed herein, a communication interface includes a display configured to display at least a portion of exercise programming.

In accordance with an aspect that may be combined with any one or more other aspects disclosed herein, exercise programming includes real-world exercise programming.

In accordance with an aspect that may be combined with any one or more other aspects disclosed herein, real-world exercise programming is based on a real-world exercise route, and a communication interface is configured to control a resistance assembly and/or incline mechanism responsive to a real-world exercise route In accordance with an aspect that may be combined with any one or more other aspects disclosed herein, a communication interface is a network interface adapted to communicate with a remote computing system.

In accordance with an aspect that may be combined with any one or more other aspects disclosed herein, a remote computing system provides a website or other network interface usable to retrieve and/or customize real-world exercise programs.

In accordance with an aspect that may be combined with any one or more other aspects disclosed herein, a remote computing system is adapted to communicate with at least one third party to obtain data used to generate controls for a resistance assembly and/or incline mechanism.

In accordance with an aspect that may be combined with any one or more other aspects disclosed herein, an incline mechanism is configured to be automatically controlled based on a combination of one or more of map data, topographical data, video data, or image data.

In accordance with an aspect that may be combined with any one or more other aspects disclosed herein, automatic controls are control signals correlated with one or more of one or more of map data, topographical data, video data, or image data.

In accordance with an aspect that may be combined with any one or more other aspects disclosed herein, a resistance assembly is capable of applying both a positive and negative resistance.

In accordance with an aspect that may be combined with any one or more other aspects disclosed herein, a communication interface is communicatively linked to a resistance assembly and incline mechanism.

In accordance with an aspect that may be combined with any one or more other aspects disclosed herein, a communication interface varies operating parameters of an exercise cycle to substantially simulate terrain of a real-world exercise route by controlling a resistance assembly and an incline mechanism based on the terrain of the real-world exercise route.

In accordance with an aspect that may be combined with any one or more other aspects disclosed herein, a resistance assembly and incline mechanism are adjustable between multiple states, including at least a state in which the incline mechanism and resistance assembly are correlated to simulate a climb of a real-world exercise route, such that the resistance assembly applies a positive resistance and the incline mechanism causes a bicycle frame to be at an incline simulating a climb.

In accordance with an aspect that may be combined with any one or more other aspects disclosed herein, a resistance assembly and incline mechanism are adjustable between multiple states, including at least a state in which the incline mechanism and resistance assembly are correlated to simulate a descent of a real-world exercise route, such that the resistance assembly applies a negative resistance, and the incline mechanism causes a bicycle frame to be at an incline simulating a descent.

In accordance with an aspect that may be combined with any one or more other aspects disclosed herein, a cycle includes a lateral tilt mechanism configured to change a lateral pitch of at least a portion of a bicycle frame relative to a support surface.

In accordance with an aspect that may be combined with any one or more other aspects disclosed herein, a lateral tilt mechanism is configured to simulate a turn around a corner in real-world terrain.

In accordance with an aspect that may be combined with any one or more other aspects disclosed herein, a simulation system substantially simulates real-world exercise routes by adjusting operating parameters of at least an incline mechanism.

In accordance with an aspect that may be combined with any one or more other aspects disclosed herein, a simulation system sends control signals to an incline mechanism to vary the operating parameters of the incline mechanism, the control signals being representative of changes to vertical pitch and/or lateral pitch of a bicycle frame relative to the support surface.

In accordance with an aspect that may be combined with any one or more other aspects disclosed herein, a simulation system is configured to select real-world exercise routes that are user-customizable.

In accordance with an aspect that may be combined with any one or more other aspects disclosed herein, a simulation system includes a communication interface connectable to an exercise program generator that accesses third-parties that store exercise route information.

In accordance with an aspect that may be combined with any one or more other aspects disclosed herein, a simulation system includes a network adapter configured to facilitate communication between the simulation system and a remote server or remote database.

In accordance with an aspect that may be combined with any one or more other aspects disclosed herein, a resistance mechanism is directly or indirectly connected to a pedal assembly and is configured to dynamically adjust a difficulty in rotating the pedal assembly based at least in part on a real-world exercise route.

In accordance with an aspect that may be combined with any one or more other aspects disclosed herein, a simulation system displays route information, images, or video of a real-world exercise route.

In accordance with an aspect that may be combined with any one or more other aspects disclosed herein, an exercise system includes means for obtaining real-world exercise route information.

In accordance with an aspect that may be combined with any one or more other aspects disclosed herein, an exercise system includes means for varying a pitch of at least a portion of a bicycle frame relative to a support surface and responsive to real-world exercise route information.

DETAILED DESCRIPTION

Figure 1:
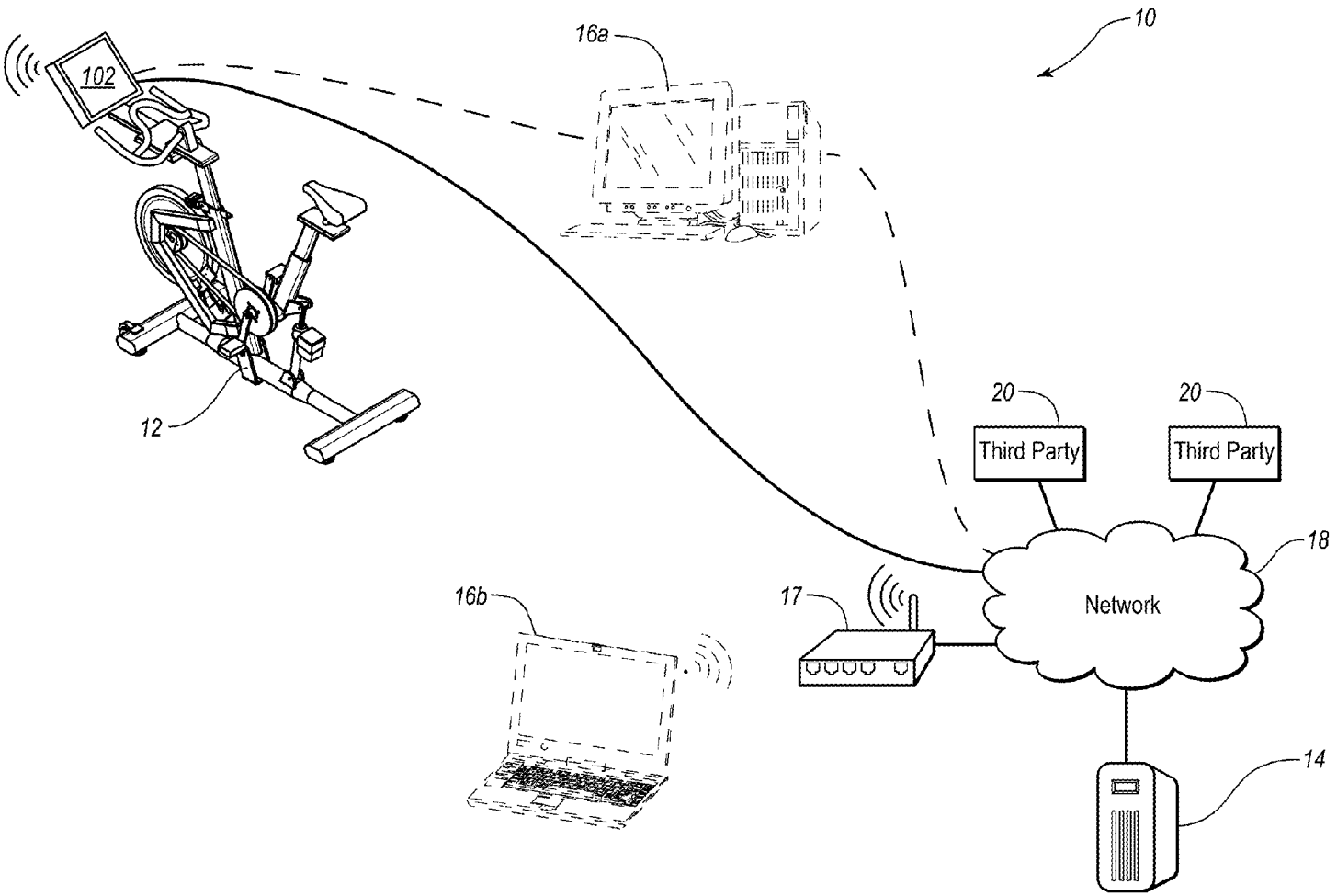
FIG. 1 is an exemplary exercise system according to the present disclosure.

In FIG. 1, an illustrative exercise system 10 is depicted, and includes a stationary exercise cycle 12 in communication with a communication system 14. The communication system 14 may include, for instance, a website or other component that can be used to provide information, such as exercise parameters and/or motivational content for use by the exercise cycle 12.

In this embodiment, the stationary exercise cycle 12 may be in direct or indirect communication with a network 18 that is a communication network that enables various hardware and software modules and devices to communicate one with another. Network 18 may therefore be a local area network (LAN), wide area network (WAN), wireless network, packetized network, real-time network, and the like. Network 18 facilitates communication of exercise cycle 12 with communication system 14. Communication system 14 assists with communication between a user on exercise cycle 12 and one or more third parties 20, as will be described in more detail hereinafter.

In the illustrated embodiment, connection between the exercise cycle 12 and network 18 can be made via a variety of communication line connections. For example, as depicted in FIG. 1, exercise cycle 12 is capable using a physical and/or wireless communication with network 18. For instance, exercise cycle 12 may use a hardwired or other similar mechanism to connect directly into network 18. Alternatively, exercise cycle 12 may be equipped for wireless communication and can, by way of illustration, communicate with the network by using a wireless router 17. Various other types of ports or interfaces may be included within exercise cycle 12 to enable communication with network 18. For instance, an exercise cycle 12 may include one or more ports and interfaces to enable communication line connection through existing broadcast technology, including television broadcast over the airwaves, cable or cable modems, satellite, telephone lines, whether analog or digitally based, the Internet, DSL, G-Lite, wireless technology, infra-red (IR) technology, other high-speed data connections, or any other suitable transmission technology or medium. In still other embodiments, exercise cycle 12 optionally connects to one or more personal computers 16*a*, 16*b*, such as by using a hardwire or wireless connection, and the personal computers 16*a*, 16*b* may in turn connect to the network 18. Thus, system 10 may allow for virtually any type of connection between an exercise cycle 12 and network 18, whether wired or wireless, and whether direct or indirect.

Similarly, although each of the elements of system 10 are shown separated one from another, it may be appreciated by one skilled in the art that the hardware and/or software elements of the present invention may be incorporated within two or more elements. For example, personal computer 16*a* or personal computer 16*b* may be incorporated within exercise cycle 12. Similarly, the hardware and/or software elements of the communication system 14 may be incorporated within the exercise cycle 12 and/or within the personal computers 16*a*, 16*b*.

As used herein, a data provider that is "external to" or "remote from" communication system 14 refers to a data provider that is administered or maintained by a third party 20 that is different than the entity that administers or maintains communication system 14. Generally, examples of a third party 20 may include: (i) a live human being; or (ii) a database, such as a website, computer, optical media (e.g., compact disk or digital video disk), visual media, or magnetic media (e.g., videotape, readable disk), an electronic monitoring system, dynamic computer readable instructions, interactive and/or dynamic software programs, computer readable instructions, one or more other databases, other media, hardware, and/or software modules and components that is/are located external to communication system 14. In some embodiments, a third party 20 may include MAPQUEST-.COM, MAP.GOOGLE.COM, the GOOGLE EARTH database, the GTOPO 30 database, the GOOGLE STREET VIEW database, the MICROSOFT VIRTUAL EARTH database, or other data providers, or any combination of the foregoing. These third parties are examples of databases or other data providers that store and maintain data external to communication system 14.

Such data providers may store image data that can be displayed or can be formatted or manipulated to be displayed on a display device 15 of the exercise cycle 12. The term "image data" includes and/or is representative of: i) one or more static images; and/or ii) one or more moving (e.g., video) images. For example, image data as used herein may include a plurality of sequential or other static images, a video, and/or a single image of terrain to be traversed by a user, such as a mountain, route path, race course, or street.

Furthermore, the phrase "display programming," as used herein, includes raw image data and/or image data that has been formatted or manipulated so that it can be synchronized with control signals and/or displayed on a display device of an exercise device. Examples of such display programming that can be used to display images on display 15 include video programming, a set of sequential static images, other non-sequential static image, programming, and/or a single image of terrain to be traversed, for example.

Generally, system 10 enables exercise programming with control signals to be transmitted from communication system 14, to the exercise cycle 12. As disclosed in U.S. patent Ser. No. 09/349,608 entitled "Systems and Methods for Providing an Improved Exercise Device with Motivational Programming," which is incorporated herein by reference, the programming may include motivational content and/or one or more control signals that may be used to control the operating parameters of the exercise cycle 12. The control signals may be synchronized with the motivational content and designed to control one or more operating parameters of the exercise device, such as the resistance or, as described herein, the vertical or horizontal incline, and the like of an exercise program performed on exercise cycle 12.

As used herein, the term "motivational content" is used to broadly refer to video or visual material either alone or in combination with audio material, including dialog, narration, sound effects, and/or music. In one embodiment of the present disclosure, motivational content is at least partially stored by a third party 20 and includes images, whether still or moving, of real world environments, routes, locations, and the like.

Various terms are used herein to describe actual outdoor exercise experiences that can be simulated on exercise cycle 12. These terms include real world environments, places, routes, trails, paths, courses, hikes, locations, and the like. It will be appreciated that these terms are used to broadly refer to characteristics of actual places in the world, including the topography, appearance, and sounds associated with the real world places. Additionally, exercise system 10 is described as being able to simulate these real world places. Simulating these real world places refers to providing a user of an exercise device an experience that is similar to actually being in the real world places. In other words, system 10 is adapted to replicate on the exercise cycle 12 the topography, sights, and/or sounds that a person would experience were the person to actually to walk, run, ride, or the like, through the actual real world location.

Generally, communication between exercise cycle 12 and communication system 14 and/or a third party 20 may include transmission of both motivational content and control signals, whether or not such control signals are synchronized with the motivational content. Alternatively, the communication may include only the motivational content, other signals representative of measurable parameters of the exercise device (e.g. inclination, resistance, etc.) and/or a user of the exercise device (e.g. heart rate, blood pressure, etc.), and the like. For example, exercise cycle 12 may transmit one or more signals to communication system 14. The signal may include parameters such as the status of the exercise device, e.g., active status (i.e., on), deactivated status (i.e., off), standby status (i.e., waiting), and the like, and/or parameters such as inclination or resistance. The signal may further include parameters regarding the user, such as heart rate, blood pressure, and the like. Alternatively, exercise cycle 12 may receive programming broadcast or otherwise transmitted by communication system 14. In embodiments in which the programming is broadcast, the broadcast may be such that any treadmill with the capabilities to receive the programming may access such, without the need to transmit one or more signals requesting the information. In other aspects, the exercise cycle 12 may receive programming directed specifically to the exercise cycle 12.

As mentioned above, the control signals control the operating parameters of exercise cycle 12, such as inclination, resistance, and the like. Such control may be achieved by communication system 14, or a combination of communication system 14 and a third party 20 interacting with exercise cycle 12 and/or communication system 14. Generally, the present disclosure allows control of a device, such as an exercise cycle, without the need to interrupt other portions of the programming, such as real-time audio and/or video.

Reference to various components of FIG. 1 will be made throughout this disclosure so as to illustrate various aspects in which embodiments of the present disclosure may operate to provide systems and methods contemplated herein. It should be appreciated that such reference is provided merely to illustrate one manner in which exemplary systems and methods may operate, and are not intended to be limiting of the present disclosure.

Figure 2:
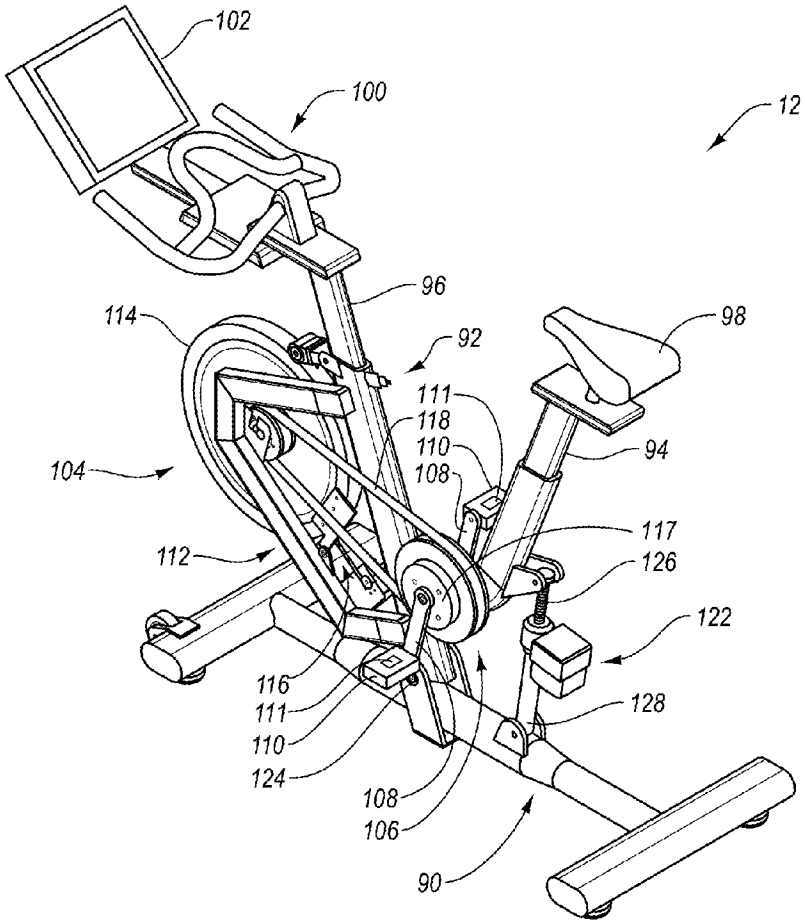
FIG. 2 is a perspective illustration of a stationary exercise cycle usable in the exercise system of FIG. 1.
Figure 3:
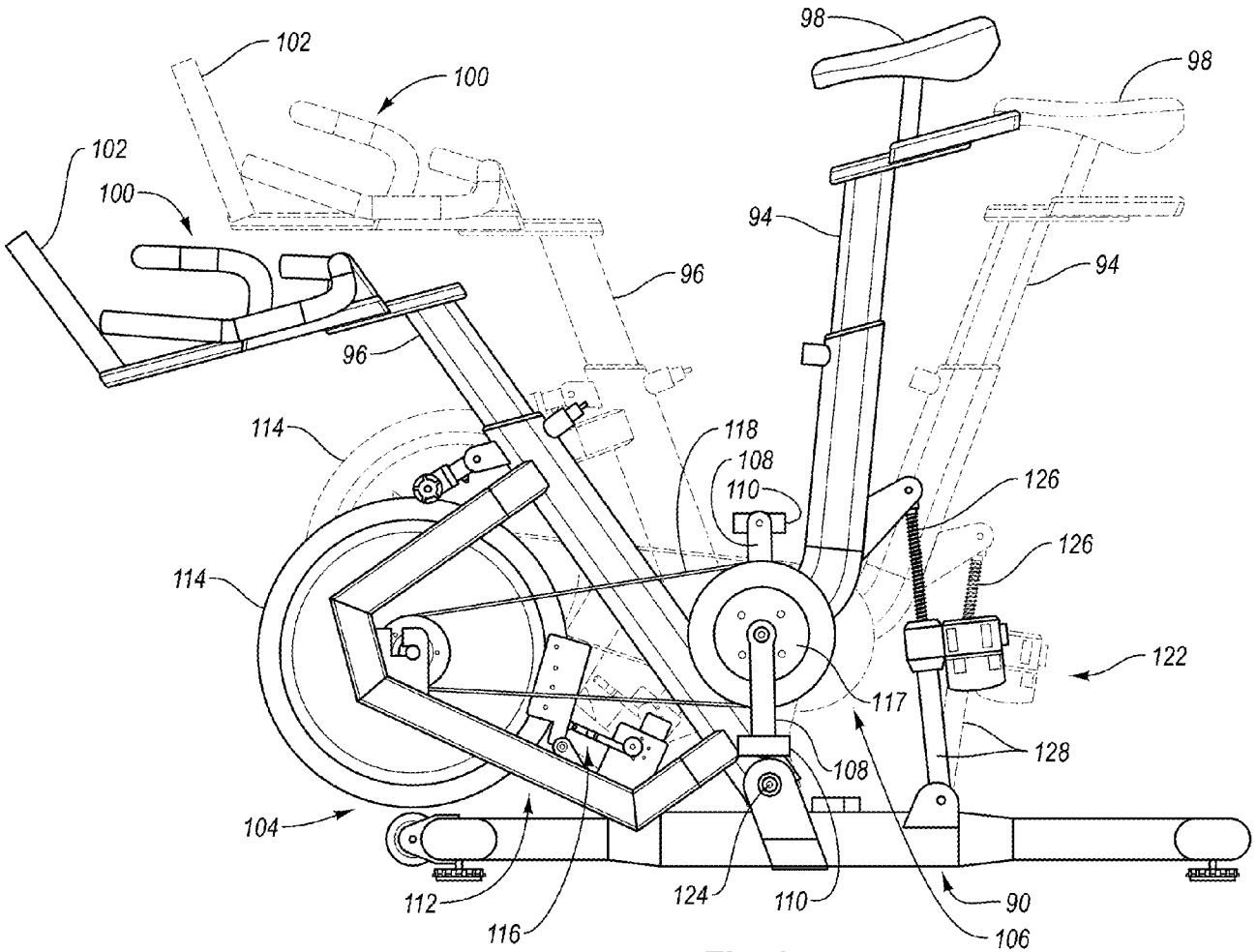
FIG. 3 is a side illustration of the stationary exercise cycle of FIG. 2 with an upright frame shown in a forward tilted position, and a neutral position featured in phantom view.
Figure 4:
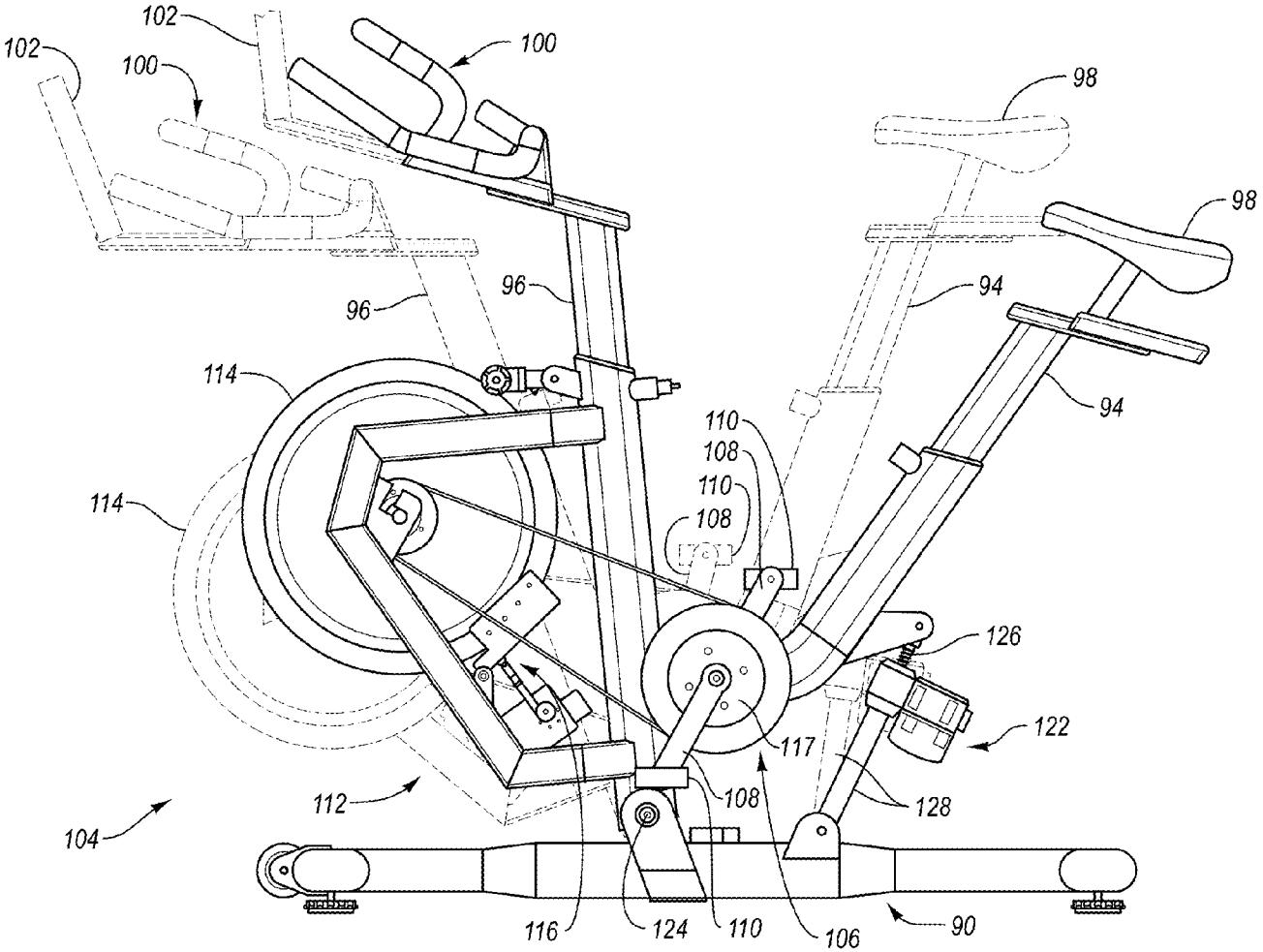
FIG. 4 is another side illustration of the stationary exercise cycle of FIG. 2 with the upright frame shown in a backward tilted position, and a neutral position featured in phantom view.

Attention is now directed to FIGS. 2-4, which generally illustrate an exercise cycle 12 that can be used with system 10 of FIG. 1. Exercise cycle 12, in one embodiment, includes a support base 90 and a generally upright support structure 92 pivotally coupled thereto. Upright support structure 92, in this illustrative embodiment, includes two support members 94, 96, and may be referred to as a bicycle frame, although it need not look like, or act like, a bicycle frame of a road or mountain bicycle used in real-world cycling. Support member 94 of the illustrated embodiment includes a seat 98 upon which a user may sit when exercising on exercise cycle 12. Support member 96 includes a handlebar assembly 100 and a control panel 102.

In the illustrative embodiment, a drive assembly 104 is mounted on upright support structure 92. Drive assembly 104 includes a rotatable pedal assembly 106. Pedal assembly 106 includes a pair of cranks 108 that are rotatably mounted on support member 94. Attached to each crank 108 is a pedal 110, which a user can engage with his or her feet to rotate pedal assembly 106. As will be appreciated by one skilled in the art, pedal assembly 106 can also be mounted or otherwise secured relative to support member 96 and/or support base 90.

Drive assembly 104 also includes, in this embodiment, a resistance assembly 112, which can affect the force required from the user to rotate pedal assembly 106. Resistance assembly 112 includes a flywheel 114, a resistance mechanism 116 mounted on or relative to support member 96, and an electric motor 117 coupled to the crankshaft extending between cranks 94. Resistance mechanism 116 and electric motor 117 are optionally each adapted to selectively adjust the force required to rotate the pedal assembly 106. Thus, when a constant force is applied at pedal assembly 106, resistance mechanism 116 and/or electric motor 117 may vary the rotational speed of flywheel 114. In this embodiment, resistance assembly 112 is coupled to pedal assembly 106 by an endless belt or chain 118 such that the rotational speed of pedal assembly 106 and flywheel 114 are related to one another.

Resistance mechanism 116 can comprise a frictional brake, a magnetic brake, eddy brake or other electromechanical brake, or any other suitable mechanism for controlling resistance to rotation of the pedal assembly 106 and/or the rotational speed of flywheel 114. As discussed herein, the resistance mechanism 116 may be capable of providing a positive or negative resistance. For instance, when a positive resistance is provided, the user may be required to increase the force applied to pedal assembly 106 in order to rotate flywheel 114. In contrast, when a negative resistance is provided, the resistance mechanism 116 may actually provide a force that facilitates rotation of the pedal assembly 106. Thus, if a negative resistance is present, a positive force may be applied that tends to rotate pedal assembly 106 even in the absence of input from the user.

Mechanisms for applying positive and negative resistance may be combined, or may be separate. For instance, in FIG. 2, the exercise bicycle 12 may also include electric motor 117, or some other mechanism that can be used in supplying a positive or negative resistance. Electric motor 117 of FIG. 2 is attached at or near the pedal assembly 106, such as crankshaft extending between cranks 94. The electric motor 117 or other device may, for instance, be selectively actuated to apply a current that can act similar to a magnetic brake and provide a positive or negative resistance to the crankshaft, as desired. Where a positive resistance is applied—either alone or in combination with the resistance mechanism 116—the electric motor 117 can hinder rotation of the cranks 94 of the pedal assembly 106. Where a negative resistance is applied, the electric motor 117 can facilitate rotation of the cranks 94 and the pedal assembly 106. Furthermore, the resistance mechanism 116 and the electric motor 117 can also act simultaneously, even if they provide opposing forces. For instance, the electric motor 117 may be used to account for momentum in the flywheel. Thus, even if a user is simulating an uphill climb, momentum may build such that a negative resistance can be applied.

In some embodiments, the pedals 110 may include optional sensors 111. Sensors 111 can be used to detect the presence of a user on the equipment. By way of illustration, sensors 111 may include pressure sensors, proximity sensors, strain gauges, or other components that can determine when a user has his or her feet on the pedals 110. Sensors 111 can be coupled to the exercise cycle controller 120 and/or the electric motor 117. For instance, if the sensors 111 detect that there is not a user on exercise bicycle 12 or that a user does not have his or her feet on the pedals 110, the exercise cycle controller 120 may selectively disable the electric motor 117 or other mechanism that applies a negative resistance. By disabling the electric motor 117, the exercise cycle controller 120 may prevent the application of a negative resistance that could otherwise cause the pedal assembly 106 to spin on its own. For instance, using a negative resistance on a downhill portion of a route, the pedal assembly 106 could build speed, and could potentially rotate on its own at a high rate of speed. When the user then wishes to climb back on the exercise cycle 12, or even to re-engage his or her feet with the pedals 110, the rotating pedal assembly 106 could make it difficult to do so. Accordingly, disabling the negative resistance can reduce the difficulty a user may have re-starting pedaling. Electric motor 117 may additionally or alternatively be disabled above a certain rotational speed of pedal assembly 106 to prevent pedals 110 from spinning out of control.

Resistance mechanism 116 and/or electric motor 117 are optionally coupled to an exercise cycle controller 120, which may alone, or in concert with other components (e.g., a communication interface such as a network adapter or communication port) act as a simulation system as described hereafter as well as a means for obtaining real-world exercise route information, as described herein. Exercise cycle controller 120 controls the operation of resistance mechanism 116 and/or electric motor 117, and thus the rotational speed of flywheel 114 in response to various user inputs or other control signals. Exercise cycle controller 120 can be incorporated within resistance assembly 112, control panel 102, or within an optional personal computer 16*a*, 16*b* (FIG. 1).

Because resistance assembly 112 is coupled to pedal assembly 106, the positive or negative resistance provided to flywheel 114 by resistance mechanism 116 and/or electric motor 117 affects the resistance to the rotation of pedal assembly 106. In other words, when a large positive resistance is applied to flywheel 114 or crankshaft, a braking force is present and it is generally more difficult for a user to rotate pedal assembly 106. Conversely, when little or no positive resistance is applied to flywheel 114 or crankshaft, it is relatively easy for a user to rotate pedal assembly 106. Further still, when a negative resistance is applied to flywheel 114 or crankshaft, a user may be allowed to coast such that the pedal assembly 106 and/or flywheel 114 rotate even in the absence of input by the user. By adjusting the amount and/or type of resistance applied to flywheel 114, exercise cycle 12 can thus vary the speed at which a user can pedal and/or the resistance experienced by the user as he or she pedals on exercise cycle 12. In this manner exercise cycle 12 is able to simulate the types of resistances, coasting, and pedaling speeds that a user may experience if riding a bicycle outdoors.

In addition to the ability to control and vary the speed and resistance of pedal assembly 106 and/or flywheel 114, exercise cycle 12 also permits varying the vertical pitch of the exercise cycle 12 by selectively tilting upright support structure 92 relative to the floor or other surface upon which exercise cycle 12 rests. As depicted in FIG. 3 in phantom lines, upright support structure 92 can be oriented in a neutral position. In the neutral position, the illustrated exercise cycle 12 may include handle bar assembly 100 and seat 98 at generally the same vertical distance from the floor or other support surface, although such is illustrative only, and the handle bar assembly 100 and seat 98 may be at different heights, even in the neutral position.

In this embodiment, when upright support structure 92 is in the neutral position, a user sitting on seat 98 may feel that he or she is sitting on a bicycle that is on a generally level surface. Additionally, as illustrated in solid lines in FIG. 3, upright support structure 92 can be oriented in a forwardly tilted position such that the handle bar assembly 100 is vertically closer to the floor or other support structure relative to the seat 98, and relative to the position of handle bar assembly 100 in the neutral position. This is achieved by adjusting the vertical pitch of the upright support structure 92 relative to a floor or other support surface. Tilting upright support structure 92 forward as illustrated in FIG. 3 enables a user to simulate riding down a hill.

In one embodiment, such as that illustrated in FIG. 4, upright support structure 92 can also be oriented in a backwardly tilted position in which the handle bar assembly 100 is vertically further from the floor or other support structure when compared to the seat 98 or when compared to the position of the upright support structure 92 in the neutral position. Typical bicycle rides outside involve inclines and declines as well as flat surfaces, each of which can be accommodated and replicated by the tilting ability of upright support structure 92. Thus, exercise cycle 12 is able to more closely simulate a typical outdoor bicycle ride.

The forward and backward tilting of upright support structure 92 to adjust the vertical pitch of the support structure 92 can be accomplished through pivotally coupling upright support structure 92 to support base 90 as depicted in FIGS. 3 and 4. As seen in FIGS. 3 and 4, upright support structure 92 is connected to support base 90 by pivot 124. Pivot 124 allows upright support structure 92 to tilt forward and backward as described herein. Pivot 124 can include a pin that extends through a portion of support base 90 and through upright support structure 92. Pivot 124 can also include one or more stops to limit the tilting of upright support structure 92 within a desired range. Pivot 124 can, in some embodiments, include a ball joint allowing the upright support structure 92 to tilt forward or backward relative to the floor or other support surface, or even tilt from side-to-side as described herein.

While pivot 124 allows upright support structure 92 to tilt forward and backward, extension mechanism 122, or another linearly or otherwise extending assembly, controls the vertical pitch of upright support structure 92. In the illustrative embodiment, extension mechanism 122 is coupled between support base 90 and support member 94. More particularly, a first end 126 of extension mechanism 122 pivotally couples to support member 94 while a second end 128 of extension mechanism 122 pivotally couples to support base 90. Extension mechanism 122 raises or lowers support member 94 relative to support base 90, thereby determining the vertical pitch and tilt of upright support structure 92 relative to the floor or other support surface. Extension mechanism 122 can also be coupled between support base 90 and support member 96 or drive assembly 104.

As with resistance mechanism 116 and/or electric motor 117, extension mechanism 122 is optionally coupled to exercise cycle controller 120. Exercise cycle controller 120 controls the operation of extension mechanism 122, and thus the tilt of upright support structure 92 in response to various user inputs or other control signals.

In one embodiment, upon contraction of extension mechanism 122, support member 94 is lowered, causing upright support structure 92 to tilt backward so that seat 98 is at a distance relative to the floor or other support position that is below the position of the seat 98 when at the neutral position. When extension mechanism 122 is selectively extended to an extended position, support member 94 is raised, causing upright support structure 92 to tilt forward so that seat 98 is vertically higher relative to the seat 98 when at the neutral position. Through the forward and backward tilting of upright support structure 92, as described above, exercise cycle 12 is able to more closely simulate for a user the experience of riding a bicycle on level ground as well as up and down hills.

Figure 8:
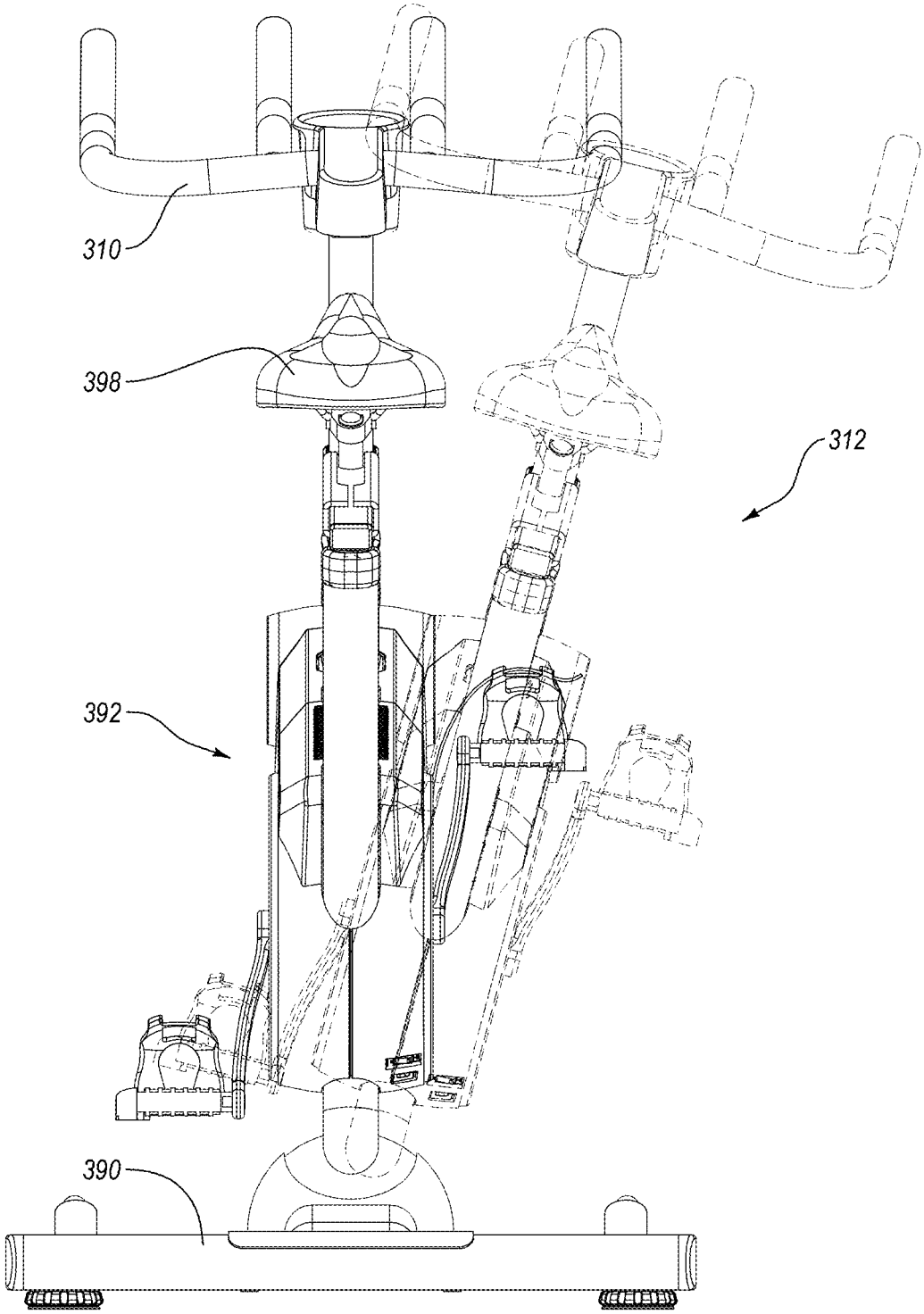
FIG. 8 is a rear view of the stationary exercise cycle of FIG. 7 with an upright frame shown in a neutral position, and a side tilted position featured in phantom view.

Extension mechanism 122 is illustrated as being located at the rear of the exercise cycle 12, although this is exemplary only (see FIG. 8). Furthermore, extension mechanism 122 may take any number of suitable forms. For instance, extension mechanism 122 may use a rotating or threaded drive shaft to adjust the length of extension mechanism 122, and thus the vertical pitch of upright support structure 92. In other embodiments, extension mechanism 122 may include a rod and piston assembly. For instance, a pneumatic or hydraulic actuator may be used to adjust the length of extension mechanism 122 and thus the vertical pitch of upright support structure 92. Extension mechanism 122 may also use any other suitable linear or other actuation mechanism that can adjust the pitch of upright support structure 92. Thus, extension mechanism 122 is one example of a means for varying a pitch of at least a portion of a bicycle frame relative to a support surface and responsive to obtained real-world exercise route information. Further, while extension member 122 is currently illustrated as being visible during operation or use of exercise cycle 112, such is merely for illustration purposes. In some embodiments, a shroud, casing, or other covering may enclose extension member 122. For instance, a flexible fan-fold material may enclose extension member 122.

Attention is now directed back to system 10 of FIG. 1, and an exemplary manner in which system 10 can be used to simulate an outdoor exercise experience. More specifically, the following discussion will be directed toward how system 10 can be used by a user to: i) select a real world route, trail, path, or course; ii) exercise on an exercise cycle that simulates the terrain of the selected real world route, trail, path, or course; and/or iii) view images of the real world route, trail, path, or course while exercising on the exercise device 12.

Figure 5A:
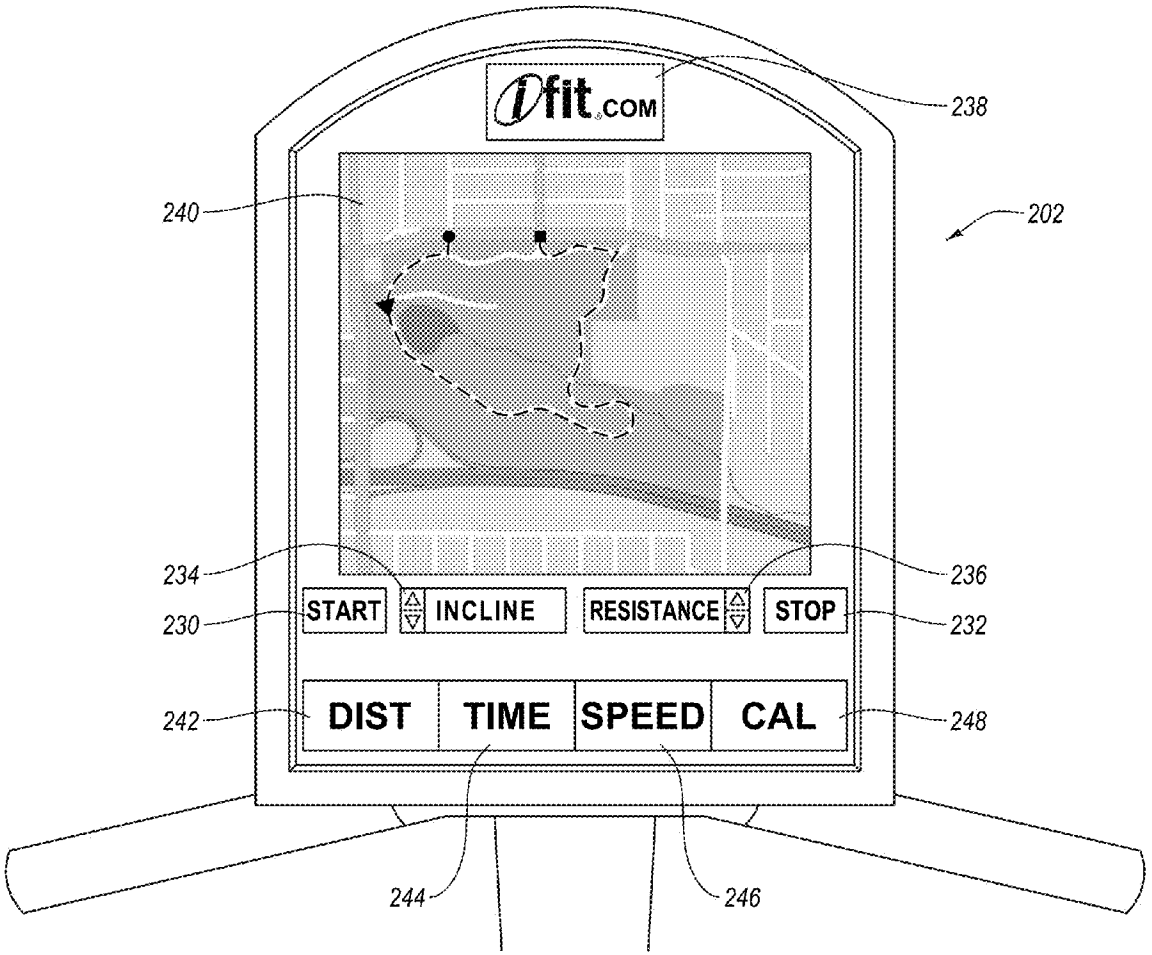
FIG. 5A illustrates the control panel of the stationary exercise cycle of FIG. 2, the control panel displaying a map view of real word terrain.
Figure 5B:
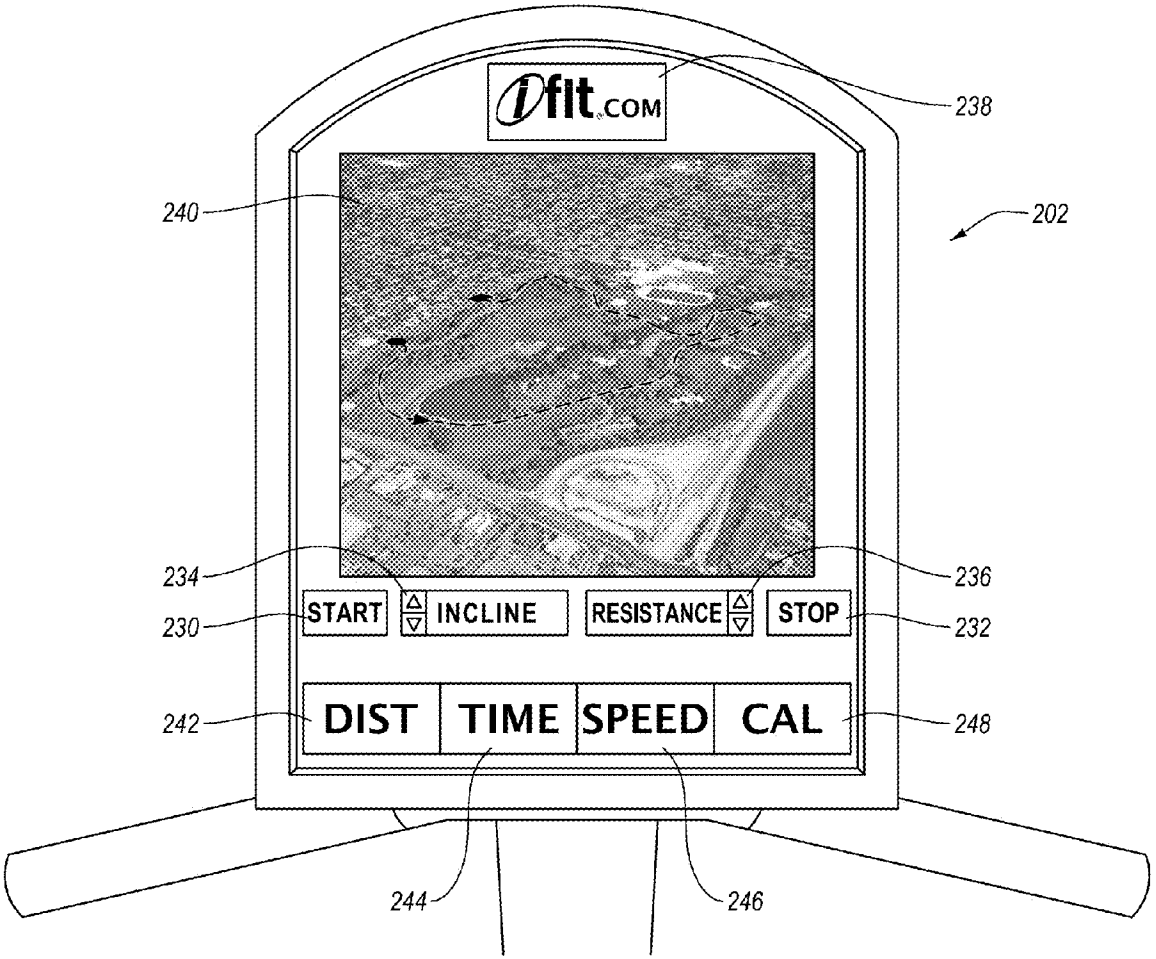
FIG. 5B illustrates the control panel of the stationary exercise cycle of FIG. 2, the control panel displaying a satellite view of real world terrain.
Figure 5C:
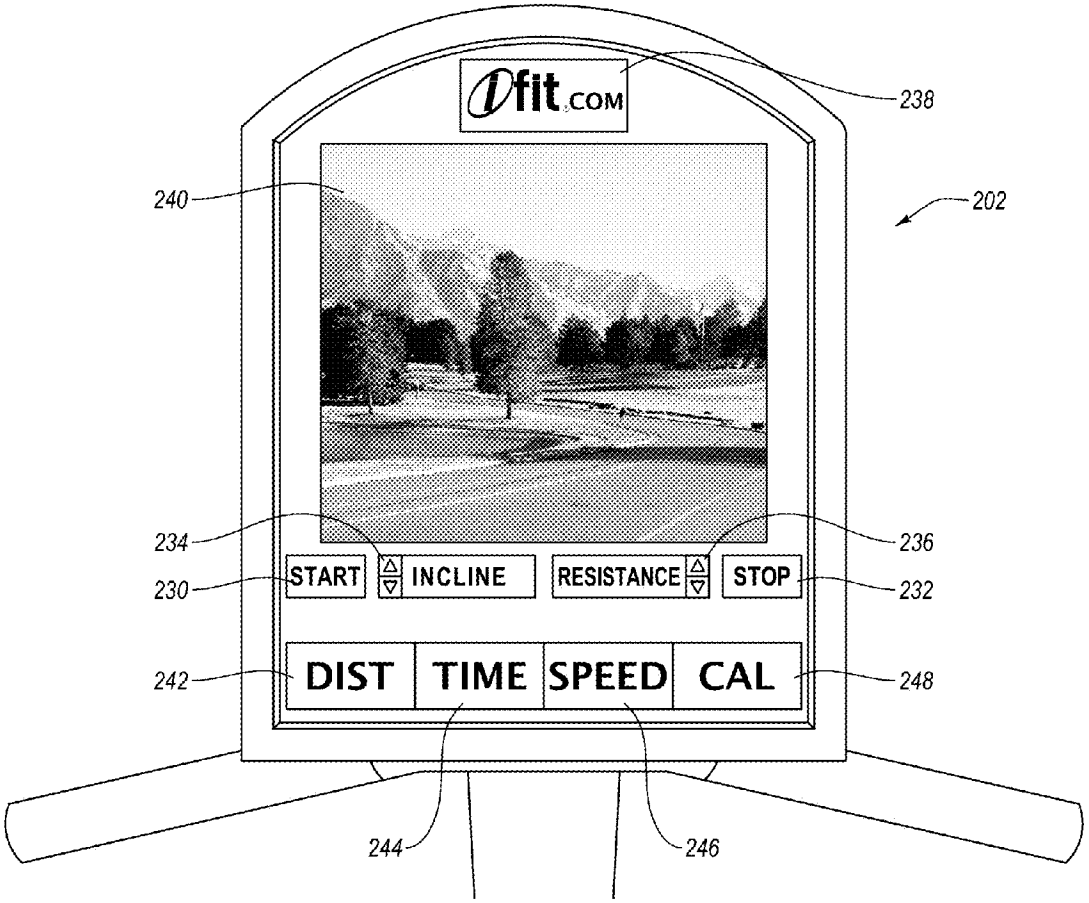
FIG. 5C illustrates the control panel of the stationary exercise cycle of FIG. 2, the control panel displaying a street view of real world terrain.

As shown in FIG. 2, exercise cycle 12 includes control panel 102 attached to handlebar assembly 100 and/or upright support structure 92. FIGS. 5A-5C illustrate an exemplary control panel 202 in greater detail. In particular, control panel 202 can include one or more interface devices. Such interface devices may be either input devices or output devices. Input devices enable a user to input and vary the operating parameters of an exercise cycle. As examples of such input devices, control panel 202 includes one or more controllers for use on an exercise device, such as exercise cycle 12. Illustrative input devices include but are not limited to a start button 230, stop or pause button 232, incline controls 234, and resistance controls 236. Still other input devices may include element such as time controls, distance controls, program selection controls, heart rate controls, and the like. In addition to these input devices, control panel 202 further optionally includes a communication system connection interface 238, such as the iFit.com button illustrated in FIGS. 5A-5C. Still other inputs or controllers may include a manual override control, a scaling control, or other input controls, each of which are also examples of input devices. It may be appreciated that each of the above-recited controllers or buttons may be embodied in a variety of different manners to perform their desired function. In addition, each controller, button, and the like may take the form of one or more switches, rheostats, potentiometers, touch sensitive controls, voice activated controllers, and the like. The input devices described herein are examples of structures capable of performing the function of interface means for gathering a first signal (such as a real time signal) from the user. One skilled in the art may identify various other configurations of interface means that are capable of performing the desired function.

In addition to the above-described input devices control panel 202 may include a variety of other input devices. For example, control panel 202 may include an integral mouse or a mouse jack for an external mouse. Control panel 202 may also include a keyboard or a keyboard jack for an external keyboard. Various other ports for use with other external components, or controls to implement integral controls, may also be included. In some embodiments, the control panel 202 includes a touch-sensitive video display 240 that may be used as an input device. Additionally, in an optional embodiment in which the exercise cycle 12 is connected to a personal computer (e.g., personal computer 16*a*, 16*b* of FIG. 1), one or more of the input devices may be incorporated into the personal computer.

Referring back to FIG. 1, each input device can be adapted to allow a user operating exercise cycle 12 to more fully operate one or more operating parameters of exercise cycle 12. Furthermore, the input devices enable the user to access communication system 14 and/or obtain maps, topographical information, pictures or videos of real world places, or other information via network 18, whether such information is from communication system 14, one or more third parties 20, or from one of a variety of other hardware and/or software modules that are accessible via network 18. For example, the input devices may allow the user to access the Internet to find map data, topographical data, pictures, and/or videos of real world locations, routes, paths, courses, location information, and the like. These additional input devices are further examples of structures capable of performing the function of interface means, communicating with the exercise mechanism, for gathering a first signal from the user.

In one embodiment, the iFit.com button 238 (FIGS. 5A-5C) acts as a selector and/or an indicator of connectivity of exercise cycle 12 to communication system 14, and optionally one or more third parties 20, whether such connectivity is maintained directly with network 18 or in another direct or indirect manner. The iFit.com button 238 optionally includes an indicator light (not shown) that demonstrates when a connection has been established between exercise cycle 12 and communication system 14, such as when the iFit.com button 238 is depressed. Alternatively, a light emitting diode (LED) or other indicator positioned in close proximity to the iFit.com button 238 may be activated when the iFit.com button 238 is activated.

As discussed above, the connection achieved by activating iFit.com button 238 may be via a variety of communication line connections. For example, control panel 202 of FIG. 5A may include a wireless port (not shown) that enables exercise cycle 12 to wirelessly communicate with network 18, either by using wireless router 17, or optionally using one of computers 16*a*, 16*b*. Alternatively, control panel 202 may have a direct or indirect hard wire connection to network 18.

In one embodiment, by activating iFit.com button 238 or another suitable mechanism, a user of exercise cycle 12 connects to communication system 14, which may be or include a website. As discussed herein, such connection may be made through wireless router 17, directly through a local area network (LAN), wide area network (WAN) by way of the described communication line connections for example, through a modem, through optional independent computers such as computers 16*a*, 16*b*, or by using other connections known to one skilled in the art in view of the disclosure herein. More specifically, by activating the iFit.com button 238 or other connection mechanism, a signal may be transmitted via network 18 to communication system 14 to establish a connection or transaction therebetween.

Once a connection is made between exercise cycle 12 and communication system 14, a user may access various programs, features, and the like of communication system 14. For example, once a connection is made, a user can access, select, create, and/or download exercise programming for use with exercise cycle 12. As discussed herein, the exercise programming can include one or more signals that are able to adjust one or more operating parameters of exercise cycle 12 as well as visual and/or audio programming. With an established connection to communication system 14, the user can also select other options, such as personal training, health information, competition, diagnostics, and the like.

Figure 6:
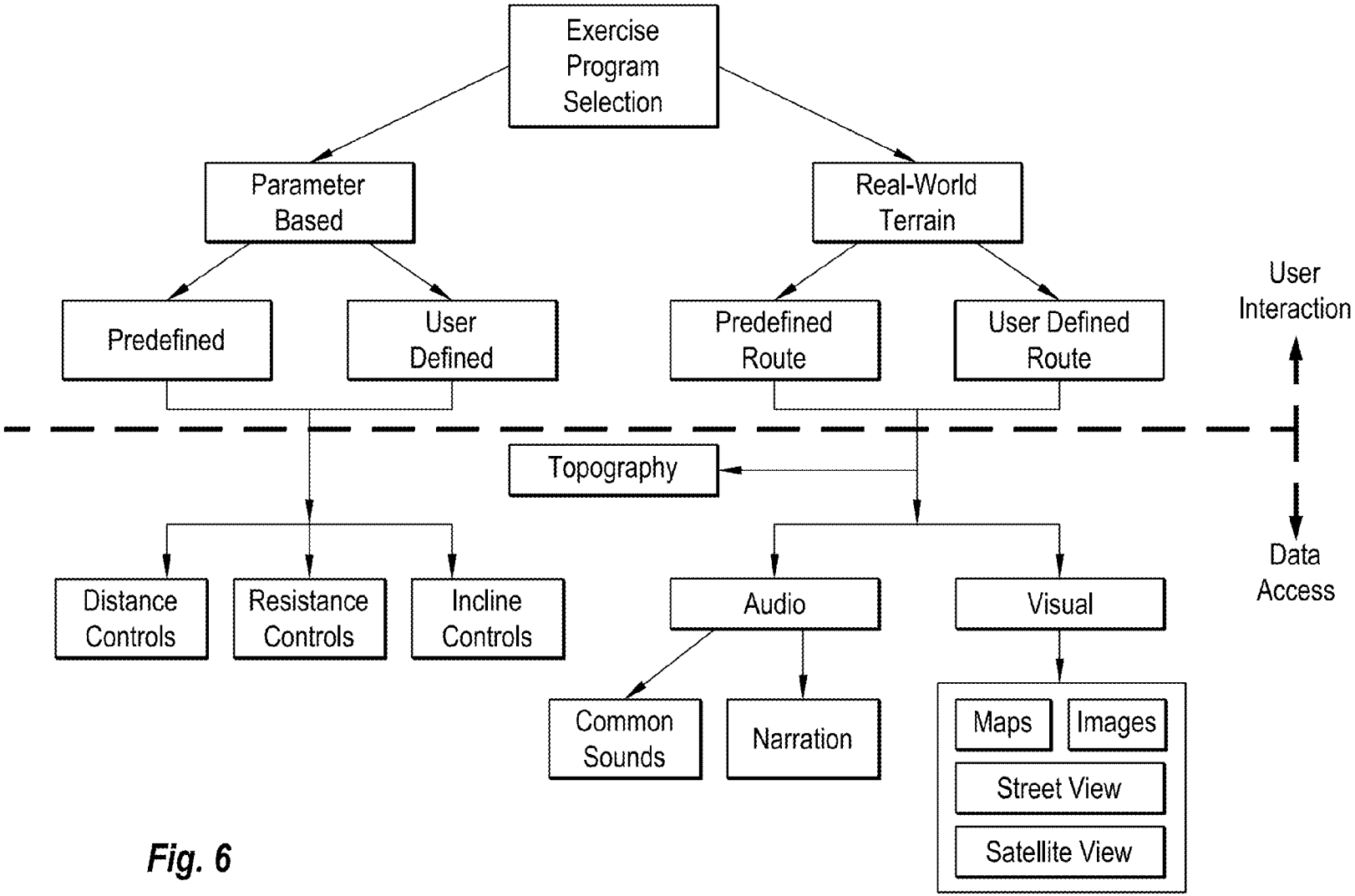
FIG. 6 is a functional block diagram of a process of selecting an exercise program to run on the stationary exercise cycle of FIG. 2.

FIG. 6 illustrates an example flow chart for selection of an exercise program for use with exercise cycles such as those described herein. To illustrate an example method in which the flow chart of FIG. 6 may be implemented, FIG. 6 may be described with reference to components illustrated in FIG. 1. FIG. 6 generally illustrates a method having two primary components, namely a user interaction component, and a data access component. As discussed hereafter, the data access component may also include generation of user defined exercise programs.

In the user interaction component of FIG. 6, selections may be made by a user. Such selections may be made directly at the control panel 102 of exercise cycle 12, although in other embodiments a user may access communication system 14 and make selections using personal computer 16*a* or personal computer 16*b*.

With a connection established between exercise cycle 12 and communication system 14, a user may access exercise programs or other features and options mentioned herein. After the user selects the desired option, such as by selecting an exercise program, communication system 14 can communicate the exercise program to exercise cycle 12 directly, via a personal computer, via a portable memory device, or in another suitable manner.

As illustrated in FIG. 6, a user may indicate that he or she would like to select an exercise program. As described herein, such selection may be in the form of a user input selecting a predefined exercise program, an input requesting to create a user defined exercise program, or an input requesting downloading of an exercise program. In response to the user input, the user may be prompted to select the type of exercise program which will be selected or created. In FIG. 6, for instance, the programming may include parameter based exercises or real-world terrain exercises, although other exercise types, such as heart-rate based exercises, may also be selected in some embodiments.

As illustrated in the embodiment of FIG. 6, regardless of whether the user selects parameter based exercise programs or real-world terrain exercise programs, the user may further be prompted to select between preprogrammed exercise programming and user defined exercise programming. When a user selects a preprogrammed exercise programming option, the user can view and select from among one or more available preprogrammed exercise programs that vary with respect to distance, incline, resistance, or other parameters, or in any combination of the foregoing. Such programs are generally defined and stored prior to the user initiating program selection, and can, through the data access portion of FIG. 6, be retrieved along with signals to control exercise parameters such as resistance and incline. In the case of real-world terrain exercise programs, additional data such as audio, visual, and other elements can be accessed and provided within the context of an exercise program. In addition to controls, audio, and visual elements, the accessed and provided exercise program may also include other elements. For instance, distance data may be included for display on a console of exercise cycle 12 to allow the user to determine how much distance has been covered and/or remains in the exercise program.

In the case of parameter based exercise programs, users optionally are allowed to define parameter based exercise programming. For instance, a user may access a computing program via exercise cycle 12, personal computer 16*a*, 16*b*, communication system 14, or any combination of the foregoing. The computing program may allow users to define programs. For instance, the user may be allowed to define intervals of a specific time or distance, and select the particular resistance, incline or other setting that should automatically occur during use of the exercise program.

The exercise programming may also be adapted to simulate a real world environment, such as a trail, route, course, path, or the like, either in the form of predefined routes, or as user defined routes. By way of non-limiting example, the exercise programming may be adapted to simulate at least a portion of the Tour de France or a favorite mountain biking trail. More specifically, the control signals can be adapted to adjust the incline/tilt and/or resistance of an exercise cycle to replicate the hills, level surfaces, and the like, encountered on the particular route.

In addition to adjusting the physical operating parameters of exercise cycle 12, the exercise programming of real-world terrain exercise programs can include video and/or audio programming that is related to the control signals. The display programming can be presented on visual display, while the audio programming can be presented by an audio output such as a speaker. A display and speaker are individually and collectively examples of programming presentation means for presenting at least a portion of exercise programming. In the example of the exercise programming simulating the Tour de France course, the display programming can include still images, video or other moving images of the course, or other visual images that include buildings, bridges, and roads that are seen along the course.

Display programming, such as maps, still images, or moving images, can be synchronized with control signals that adjust the operating parameters of an exercise cycle. Synchronizing the control signals and the display programming allows a user to view the real world environment at about the same time the user encounters operating parameters that simulate the viewed real world environment and terrain. For example, as a user cycles along a trail, the control signals may cause the exercise cycle to simulate the terrain (e.g., ascents, descents, bumps, etc.) that a cyclist would encounter as he or she rides along a mountain trail. As the user of the exercise cycle experiences the terrain of the trail, the user can also view images, whether still or moving, of the area which the control signals are simulating.

Similar to the display programming, the audio programming can include typical sounds heard by a cyclist traveling along the actual route corresponding to the real-world terrain exercise program. For instance, during a Tour de France route, the audio programming may include cheers of a crowd, cars, sirens, horns, and the like. For a mountain trail, the audio programming may include the sounds of wind rushing through trees and bushes, birds and other wildlife, and the like.

Audio programming may also provide information about the images presented in the display programming or the user's location along a route. For example, the audio programming may include information about landmarks or objects seen during the exercise routine or otherwise near the exercise route. The audio programming can be synchronized with the control signals and the display programming so that the sounds and/or information provided by the audio programming is related to what the user is seeing on a visual and experiencing on the exercise cycle. For instance, if a user is simulating a ride through Central Park in New York City, as the user views images and experiences the terrain of Central Park, the user may also hear sounds typical of the area, such as children playing, dogs parking, and people talking. Additionally, or alternatively, the user may be provided with information in narrative form about Central Park, such as its size, history, landmarks, neighboring sites, or other interesting facts.

While the exercise programming has been described above in connection with various specific examples of locations where a bicycle ride can be simulated, it will be appreciated that the exercise programming may simulate other real world environments, such as other races, mountain rides, city tours, or any other course, route, path, and the like. Indeed, some programming may be predefined or otherwise available, while other programs may be defined by a user to correspond to any of an infinite number of routes. For instance, a manufacturer of the exercise cycle may include with the exercise cycle, or at a communication accessible thereto, a set of pre-programmed real-world exercise programs that simulate real-world terrain along real-world routes, along with corresponding visual and/or audio programming. Further, as illustrated in FIG. 6, the user optionally may select a user defined exercise route as a programming option. Exercise cycle 12, a personal computer 16*a*, 16*b*, or a website or other communication system 14 may be configured to allow a user at the exercise cycle 12 or at a personal computer 16*a*, 16*b* to create exercise programming suitable to the desires of the user. When creating a user defined or unique exercise program, the user may have the option to select—among other things—a desired route, display programming, and/or audio programming. The user may also have the option to select other exercise programming parameters, such as the exercise time or distance, whether certain types of terrain should or should not be simulated, number or type of turns, changes in the vertical or horizontal incline/tilt of the cycle, and the like.

By way of example, a user accessing a website may be able to select a real world environment which he or she would like an exercise cycle to simulate. In selecting the real world environment, the user may select a starting point, an ending point, and a specific route between the two. Alternatively, the user may select a starting point and an ending point, and allow the website and/or one or more third parties to select the route therebetween. In still other embodiments, the user may select a starting point and allow a website and/or one or more third parties to select a route that proceeds from, and optionally returns to, the starting point for a selected time, distance, or the like. As noted above, the real world environment may be a famous or well known race course, tour route, trail, or the like, although a user may create an exercise program that simulates virtually any other real world environment, without regard to whether the location is famous or well known.

For instance, during good weather, a user of an exercise cycle such as those disclosed herein may also like to ride outdoors along a route the user has developed, such as along the roads in his or her neighborhood. During bad weather, however, the use may prefer to ride indoors on stationary exercise cycle 12. In such a case, the user may access a website using the exercise cycle and/or a personal computer and create an exercise program that simulates his or her neighborhood route. More specifically, the exercise program can include controls signals that adjust the operating parameters of the exercise cycle to simulate the actual terrain (e.g., ascents, descents, and level surfaces) of the neighborhood route. Additionally, exercise programming can also provide display programming showing images of the neighborhood route. As with the preprogrammed exercise programs, the display programming can be synchronized with the control signals so that a user is able to view images of the real world environment associated with the actual terrain that is simulated on the exercise cycle.

In order to generate exercise programming as described above, a website or workout generator may access one or more types of data. Some types of data that may be used to generate the above described exercise programming include maps, topographical data, video or image data, audio data, and the like. Map data allows the user to create a route through a real world environment which will be simulated on the exercise cycle. The topographical data can be used to automatically and/or dynamically generate or provide control signals that adjust one or more operating parameters of the exercise cycle to simulate the actual topography and terrain along the real world route. The video/image data and the audio data can be used to provide the user with a visual representation of and/or audio information relating to the real world route that is simulated on the exercise cycle. Still other information may also be accessed. For instance, a database may include information about the type of surfaces the real world route traverses. Based on the type of surfaces, control signals may be generated to simulate bumps or other structures. For instance, while a paved highway may have a surface generally free from rocks or bumps, a mountain trail may be far less smooth, such that bumps may be simulated. Such bumps may be random, pseudorandom, or otherwise generated. In other embodiments, speed bumps may be simulated. Similarly, if a road is shown to be under construction, bumps may also be expected and simulated.

The data used to generate the exercise programming may be stored at one or more locations. For example, a website or computing system may have a local database that can be accessed, or may communicate with one or more third parties 20 which store data. Third parties 20 may be websites and/or databases that are accessible via a network 18. The following are a few examples of third parties 20 that can be accessed to retrieve information and data that can be used to generate the exercise programming described herein.

There are multiple route planning and mapping software applications and programs which can be used by a website, personal computer, or a user at an exercise cycle such as those described herein to develop a route that may be used for exercise programming in accordance with the present disclosure. Examples of such are MAPQUEST.COM, MAPS.GOOGLE.COM, and GOOGLE EARTH (available at earth.google.com). With these applications, a user is able to select a starting point and an ending point. The applications provide one or more different routes between the two points. Alternatively, the applications may be modified to allow for the creation of customized routes between the beginning and end points by, for example, selecting intermediate points between the beginning and ending points. Such databases may also store information about the type of roadway that can be used, for example, in determining whether the road is likely to have bumps or rocks.

Similarly, there are multiple databases that store topographical data for specific regions of the world. In addition, the U.S. Geological Survey maintains a database, the GTOPO 30 or Global Topography at 30 arc/second database (available at edc.usgs.gov), which includes topographical data for the entire world. An exercise program generator can access one or more of these databases to retrieve information and data regarding the real world route that is to be simulated on an exercise cycle. With this data, the program generator can generate the control signals that control one or more of the operating parameters of the exercise cycle, such as the incline and/or tilt of the cycle, to simulate the terrain of the real world route.

Databases that store still or moving images of real world locations can also be accessed by the program generator or another component working in connection therewith, so as to provide to the user of exercise cycle 12 a visual representation of the real world route that is simulated on exercise cycle 12. Examples of such databases include the GOOGLE EARTH, GOOGLE STREET VIEW (available at MAPS.GOOGLE.COM), and MICROSOFT VIRTUAL EARTH (available at www.microsoft.com/virtualearth) databases. These databases provide a bird's eye view and/or a street level view of a selected route or location.

With access to at least some of the data described above, a website, personal computer, or other exercise program generator is able to generate exercise programming that allows an exercise cycle such as those disclosed herein to simulate real world environments. In one embodiment, a user of exercise cycle 12 accesses a communication system 14 via a control panel 102. The communication system 14 may provide a user interface that allows the user to select a preprogrammed exercise route or create a user defined exercise route, either of which optionally are related to real-world terrain. In the case of creating a user defined exercise route, communication system 14 can allow the user to enter a starting point at a real world location, an ending point at a real world location, and/or one or more intermediate real world locations that will define the exercise route.

With the supplied starting point, ending point, and/or one or more intermediate points, communication system 14 communicates with one or more third parties 20 that provide map and topographical data relating to the selected route. The map and topographical data provided by the third parties 20 may include a map highlighting the selected route, total route distance, route directions, travel times for specific speeds, as well as forward, backward, and side-to-side elevation changes along the selected route.

Communication system 14 can also communicate with one or more other third parties 20 to retrieve other data relating to the selected route. Communication system 14 can, for example, communicate with the GOOGLE STREET VIEW database to retrieve images, video, or other content related to the selected route. Furthermore, communication system 14 can access other types of databases, such as audio databases, that provide audible information relating to the selected route.

Once communication system 14 has retrieved the desired information for the selected route, communication system 14 or another component can compile the gathered data and generate an exercise program. Communication system 14 may use the map, topographical, or other data to automatically and/or dynamically generate a sequence of control signals that control one or more operating parameters of the exercise cycle 12. For instance, using a correlation algorithm, communication system 14 can synchronize topographical data with map data to correlate the distance and the grade or elevation change between two points on the selected route and generate a control signal that will cause exercise cycle 12 to simulate that terrain by adjusting the incline/tilt and/or resistance of the exercise cycle 12. For instance, a route can be made up of any number of discrete portions, which portions may be set based on predetermined or user-configurable criteria. For instance, an automatic setting may break-up a selected route in to quarter-mile, half-mile, or other increments to calculate the corresponding incline, resistance, and the like. Increments may be set based on additional or other factors as well, such as where a user makes a left or right hand turn, a location where a significant slope change is encountered, locations where the user encounters an intersection with a stop light, stop sign, or other signage, or based on other factors or any combination of the foregoing. Regardless of the particular manner in which the route is segmented, the correlation algorithm may compute the particular incline for a portion of a path. In one example, the correlation algorithm determines incline by determining the distance of a segment and the elevation change over a segment. The correlation algorithm may include setting the incline to a value corresponding to the elevation change divided by the distance. Accordingly, in one example, the communication system 14 can use the map data to determine that the distance between point A and point B is half a mile, or 2640 feet, and that the elevational change is about 320 feet. By dividing the elevational change by the distance, the topographical data may thus be used to determine that the segment between points A and B has a grade of about twelve percent. Using this information, communication system generates one or more control signals that will cause the exercise cycle to incline its upright support structure 92 (FIG. 2) to approximately a twelve percent grade until the user has cycled for a half mile.

In a similar manner, communication system 14 can use the map data, the topographical data, and other reference points along the selected route to generate control signals that control the resistance applied to the flywheel 114 and/or the pedal assembly 106 (FIG. 2). For instance, as simulation of an uphill climb begins, the resistance may increase. Similarly, as simulation of a downhill ride begins, the resistance may decrease and in some cases an optional positive force, or negative resistance, may be applied. In one example, the correlation algorithm determines the force applied by a resistance mechanism (e.g., resistance mechanism 116 and/or electric motor 117 of FIG. 2) by multiplying the incline by a constant force, and then subtracting a friction factor. In some cases, an approximate value for gravitational force may be used as the constant force.

While the generated positive or negative resistance may be constant along a segment of a route, it should also be appreciated in view of the disclosure herein that in order to more realistically simulate an actual ride, the resistance may vary based on other factors such as the speed at which the user is moving. By way of illustration, if a user starts from a stop, there is no momentum built up in the flywheel. As a result, the applied resistance may initially start at a higher value, and gradually decrease as the user begins moving. In some cases, a negative resistance mechanism (e.g., electric motor 117 of FIG. 2) may be used to account for momentum in the flywheel. In such a case, a negative resistance may be applied while a user is moving. If, however, a user starts from a stop, the application of the negative resistance may be delayed and may gradually increase as momentum increases.

In addition to generating or accessing control signals, the communication system 14 can optionally generate and/or accumulate display programming to accompany the control signals. As mentioned herein, the display programming can include still images or actual video or other moving images of the selected real world route, which communication system 14 retrieves (e.g., from one or more third parties 20). For example, communication system 14 communicates with a third party 20, such as the GOOGLE STREET VIEW database via the GOOGLE MAPS application programming interface (API), to retrieve a series of images from of the selected real world route. When a series of images are used to provide a visual depiction of the selected route, the images can be streamed, cached or buffered so that upon delivery to the user of exercise cycle 12, the images provide an almost seamless, video-like depiction of the selected real world route, although the presentation need not be video-like for all embodiments and/or locations.

As mentioned above, communication system 14 can synchronize the display programming with the control signals. In this manner, the control signals adjust the operating parameters of exercise cycle 12 at the same time the display programming depicts a change in the terrain of the real world route. For instance, at the same time the control signals begin to cause exercise cycle 12 to incline to simulate a hill on the real world terrain, the display programming shows one or more images of the hill of the real world terrain as if the user were actually beginning to ascend the hill.

Once remote communication system 14 has generated, accumulated, or otherwise accessed the control signals corresponding to the topographical/map data and the display programming from the retrieved images of the real world route, remote communication system 14 can employ a synchronization algorithm to synchronize the control signals with the display programming. In one embodiment, the synchronization algorithm synchronizes images, video, audio or other display programming based on an approximate location where the programming is to occur. Thus, the synchronization algorithm may set display to begin once a certain distance along the real world route has been traversed. In other embodiments, there may be a continuous series of retrieved images along the full real world route, each of which may be displayed for a constant distance. In such a case, the synchronization algorithm may divide the total distance of the real world route by one less than the total number of images to be displayed. As a result, the constant distance over which each image is displayed may be computed. Similarly, a synchronizing control signals with display programming may also use information from the retrieved topographical or map data, such as distances between locations on the real world route, changes in elevation between locations on the real world route, directional changes along the real world route, and the like. For example, the synchronization algorithm may correlate a display signal with a particular image at a location where there is a change in the topographical data, such where a particular elevation change begins or ends.

In some embodiments, communication system 14 also provides audio programming that is synchronized with the control signals and the display programming. The audio programming can include sounds that may typically be heard along the real world route, such as cars, sirens, animals, people, and the like. The audio programming can also include in narrative form information about sites along the real world route, or motivational content from a personal trainer encouraging a user during a particularly difficult portion of a route. For example, if a user chose to have exercise cycle 12 simulate a route through Washington, D.C., and that route passes by sites such as the White House, the U.S. Capitol Building, the Lincoln Memorial, or the Washington Monument, the audio programming could provide information about each of these sites, such as might be heard during a tour of Washington, D.C. A synchronization algorithm, such as those described herein, may be used to synchronize the presentation of the audio programming with the display programming and the control signals.

Third parties or other databases or websites that include map or topographical data may also include information about historic landmarks, or other locations. For instance, MAPS.GOOGLE.COM may also show when a route passes by a particular landmark during a simulated ride through Washington, D.C. Using that information, the narration may dynamically retrieve or generate audio clips to identify the landmarks. Additionally, or alternatively, based on information about landmarks and locations identified by map or topographical information providers, other third parties may be consulted. For instance, if the map provider indicates that a route passes through a fairly obscure city such as Hattgenstein, Germany, communication system 14 may communicate with a third party such as WIKIPEDIA.ORG or another provider to obtain additional information about the city, its culture, traditions, and the like. Audio content related thereto can thus be dynamically generated, even for user-defined routes. A text-to-audio program may be used in one embodiment, such that audio can be generated on the fly and need not be pre-recorded for a specific location to be usable in connection with aspects of the present disclosure.

When an exercise program has been generated or retrieved, the control signals, visual, audio, or other information of the selected exercise programming can be sent over a network 18 to the exercise cycle 12. Regardless of the manner in which the control signals and other information is provided and/or accessed, the exercise cycle 12 can use the control signals to control the operating parameters of the exercise cycle 12 and/or provide video/audio programming to a user. The exercise programming may include exercise routines that vary the resistance applied to flywheel 114 (FIG. 2) and/or the incline/tilt of the exercise cycle 12 at various time or distance intervals during the routine. The visual, audio, or other programming can provide various types of information, including instruction, education, and entertainment.

Returning now to FIGS. 5A-5C, an exemplary user console 202 is illustrated. User console 202 is exemplary of a user console usable in connection embodiments of exercise cycles disclosed herein. FIG. 5A, for example, illustrates user console 202 having a variety of input and/or output devices. As described previously, user console 202 includes a start control 230, stop or pause control 232, incline control 234, and resistance control 236. User console 202 also includes a set of output devices. In this particular embodiment, the output devices include a distance display 242, time display 244, speed display 246, and calorie display 248. The distance display 242 may provide for display of a distance traversed, a distance of a loaded or potential exercise program, or the like. Time display 244 may similarly provide for a duration of an exercise routine, an expected duration remaining, or the like. Speed display 246 may display a current speed or target speed for a user, while calorie display 248 may similarly display estimated calories expended during a current or loadable exercise routine.

User console 202 also includes, in this embodiment, an input device in the form of connection mechanism 238, which is in this particular embodiment an iFIT.com button. The iFIT.com button 238 may be used to, for instance, initiate or maintain communication with a remote system (e.g., application system 14 of FIG. 1). As described herein, a user may utilize the iFIT.com button or other similar device to establish a connection and retrieve, select, generate, or otherwise access an exercise program. The exercise program may include control signals to automatically change operating parameters of the exercise cycle. In addition, according to some embodiments, the exercise program may include visual, audio, or other data that is optionally synchronized with the control signals.

In accordance with one embodiment, the visual, audio, or other data that is synchronized with control signals includes real-world terrain information. For instance, as shown in FIG. 5A, user console 202 includes a display 240 capable of displaying visual data. In this particular embodiment, display 240 illustrates a map as may be provided by a third party such as MAPS.GOOGLE.COM. The illustrated map is sized to fit display 240 and, in this embodiment, includes a visual indication of a real-world route. The real-world route may follow real-world roads, paths, trails, and the like. The real-world route may also be synchronized with topographical information, such that elevation or other changes to the real world terrain are simulated through the use of corresponding control signals.

Map data may be displayed or used in accordance with any of the aspects disclosed herein. In FIG. 5A, for instance, the map data is in the form of a road map. In contrast, FIG. 5B illustrates a similar map in the form of a satellite view. The satellite view in display 240 of FIG. 5B may correspond to actual still or moving images that correspond to the real-world terrain. The satellite view may also be merged with the map view of FIG. 5A so as to generate a hybrid view. Additionally, or alternatively, route information may overlay the satellite view.

Still other display information may be provided. FIG. 5C, for instance, illustrates an exemplary street view image, such as that may be obtained from a third party such as the GOOGLE STREET VIEW database. The display 240 may display any or all of the images in FIGS. 5A-5C, and may transition therebetween. For instance, in FIGS. 5A and 5B, an indicator may display real time a location of the user on the real-world route. Street view images may cycle through and correspond to locations of the location indicator. In some embodiments, street view or other similar images are primarily displayed, while map or satellite/birds-eye views are displayed at request or intermittently.

Figure 7:
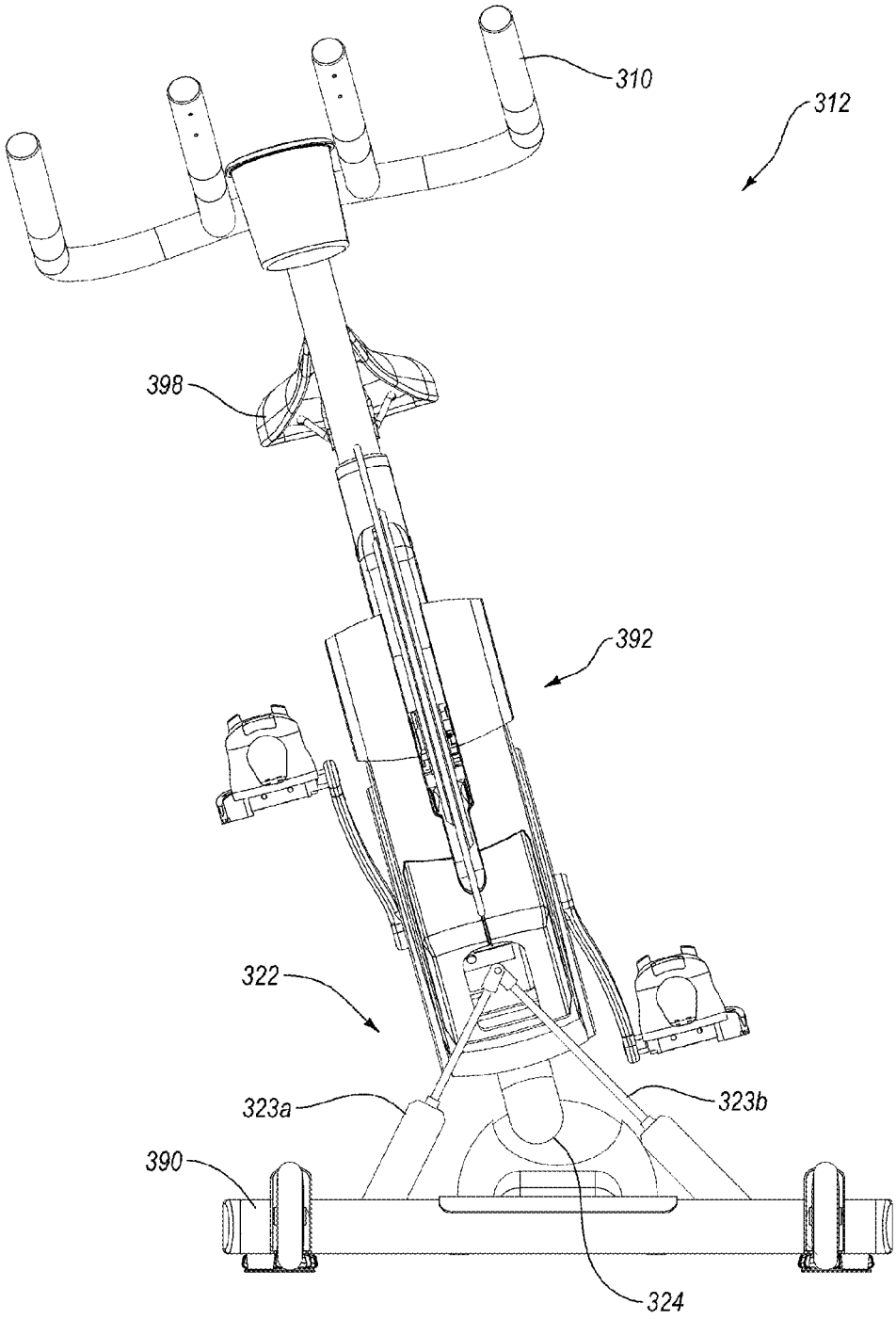
FIG. 7 is a front view of another stationary exercise cycle usable in the exercise system of FIG. 1, the exercise cycle including dual incline mechanisms.

Turning now to FIGS. 7 and 8, another example of a stationary exercise cycle 312 operable in accordance with aspects of the present disclosure is shown. As discussed previously with respect to FIGS. 3 and 4, an exercise cycle of the present disclosure may be moved so as to modify a vertical pitch of an upright support structure relative to a floor or other support surface. Such variation may allow a bicycle to give a user a feeling of going up or down a hill of a real world or other route.

In FIGS. 7 and 8, an additional or alternative aspect is illustrated. In particular, in the illustrated embodiment, the stationary exercise cycle 312 permits the horizontal tilting of an upright support structure 392 relative to the floor or other surface upon which exercise cycle 312 rests. As depicted in FIG. 8, upright support structure 392 can be oriented in a neutral position. In the neutral position, handle bar assembly 310 has a generally horizontal configuration relative to a floor or other support structure on which the upright support structure 392 is supported. When upright support structure 392 is in the neutral position, a user sitting on seat 398 will feel that he or she is sitting on a bicycle that is on a level surface. Additionally, as illustrated in phantom lines in FIG. 8, upright support structure 392 can be oriented in a lateral, side tilted position such that handle bar assembly 310 is angled relative to the floor or other surface on which tilting upright support 392 is supported. Tilting upright support structure 392 to the side as illustrated in FIG. 8 enables a user to simulate making a right turn on a bicycle. Although a tilt to only one side is illustrated, it will be appreciated that a similar configuration may be obtained and the exercise cycle 312 may tilt an opposite direction as well. Thus, right and left turns can be replicated by the lateral tilting ability of upright support structure 392. Thus, exercise cycle 312 is able to more closely simulate a typical outdoor bicycle ride.

The left and right tilting of upright support structure 392 can be accomplished by pivotally coupling upright structure 392 to support base 390 as depicted in FIG. 7. As seen in FIG. 7, upright support structure 392 can be connected to support base 390 by pivot 324. Pivot 324 allows upright support structure 392 to tilt side-to-side as described herein. Pivot 324 can include a ball-and-socket connection. For instance, a generally spherical ball may be connected to support base 390, and a corresponding collar may ride on the ball so as to move side-to-side over the ball. Pivot 324 can also include one or more stops or guides to limit the tilting of upright support structure 392 within a desired range.

While pivot 324 allows upright support structure 392 to tilt side-to-side, extension mechanism 322, or another assembly, controls the tilting of upright support structure 392 and may be considered a means for varying a pitch of at least a portion of a bicycle frame relative to a support surface, and in response to obtained real-world exercise route information.

In the illustrative embodiment, extension mechanism 322 includes two linear extenders 323*a*, 323*b* coupled between support base 390 and support member 394. More particularly, a first end of each of linear extenders 323*a*, 323*b* can be pivotally coupled to support member 394 while a second end pivotally couples to support base 390. Linear extenders 323*a*, 323*b* can be controlled independently so as to tilt support member 394 to one side or the other, thereby determining the tilt of upright support structure 392. In particular, in the illustrated embodiment, linear extender 323*a* and linear extender 323*b* have different lengths. Due at least in part to the differing lengths, the upright support structure 392 can be caused to tilt to one side or the other. More particularly, in FIG. 7, in which a right turn is simulated, linear extender 323*b*, which is on the exterior side of the simulated right turn, has a length that is greater than linear extender 323*a* which is on the interior side of the simulated turn.

As will be appreciated in view of the disclosure herein, extension mechanism 322 may also be used to simulate a forward or rear incline as disclosed above. For instance, as the length of linear extenders 322*a*, 322*b* increase, the forward portion of exercise cycle 312 may raise, thereby causing the upright support structure 392 to pivot about pivot 324, and simulate ascending a hill. Similarly, by reducing the length of linear extenders 322, the forward portion of exercise cycle 312 may lower, thereby causing upright support structure 392 to pivot about pivot 324 and simulate descent down a hill. Accordingly, where linear extenders 323*a*, 323*b* have a same length, the exercise cycle of the illustrated embodiment may be placed in a neutral position with respect to a lateral tilt, and simultaneous and corresponding changes in length thereto can result in changes to vertical incline of exercise cycle 312. Moreover, as pivot 324 may include a ball joint, changes to vertical and lateral incline may occur simultaneously such that exercise cycle 312 may simulate a turn while ascending or descending a hill.

Exercise cycle 312 may be coupled to a communication system or other expertise programming system similar to that described herein with respect to exercise cycle 12 of FIGS. 1-4. Thus, while exercise cycle 312 is not illustrated as including an integral use console, such is merely illustrative. For instance, an integral display or console may be included with exercise cycle 312, or exercise cycle 312 may be configured to use a removable display. In one embodiment, exercise cycle 312 may include a connection for a laptop or other computing device that can act as the user console, while providing automated and dynamic control of operating parameters of exercise cycle 312.

Figure 9:
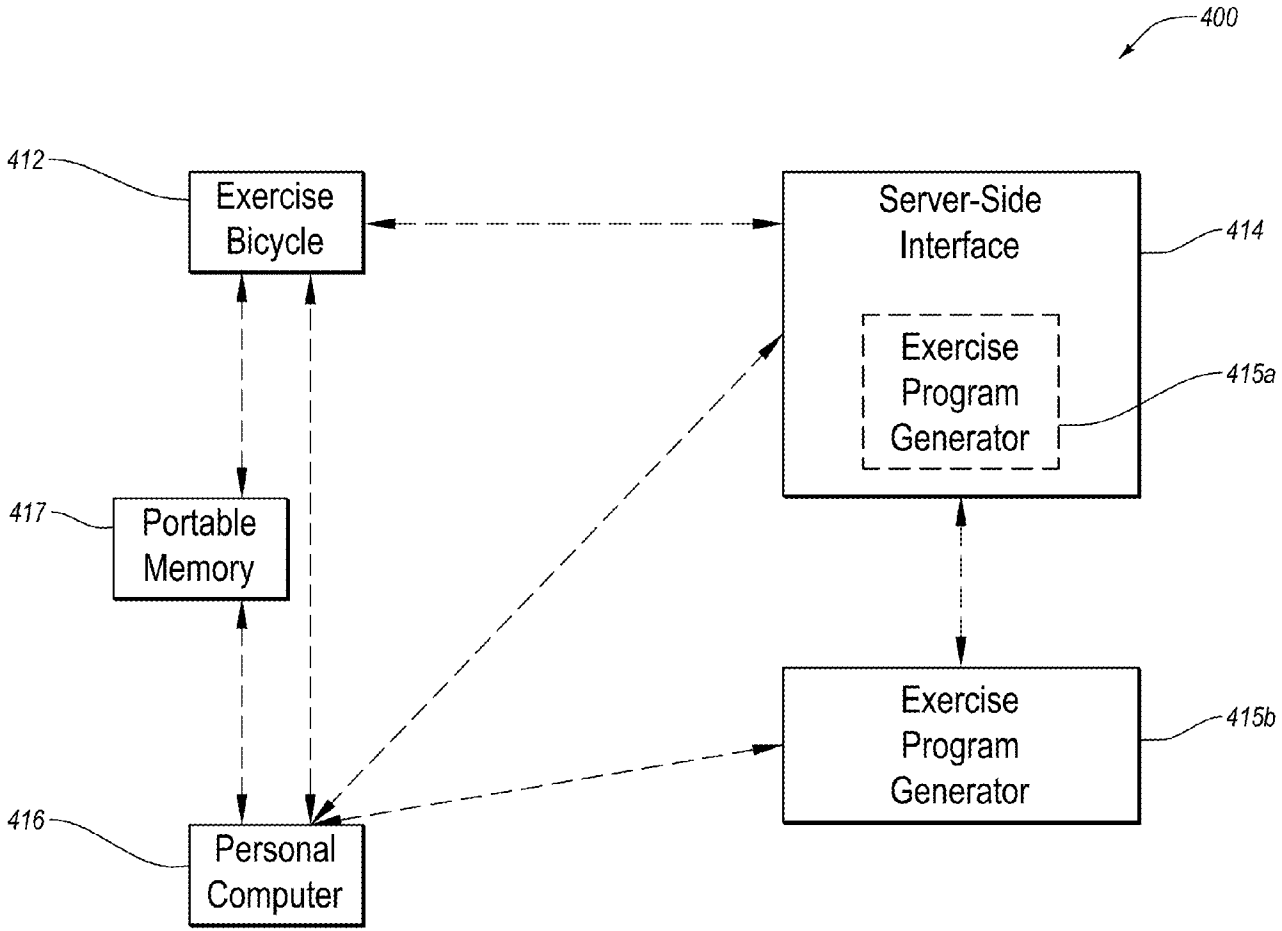
FIG. 9 is a flow diagram of a process of accessing a remote computing system, generating exercise programming, and accessing the exercise programming for use on an exercise device.

Turning now to FIG. 9, an exercise system 400 usable to automatically control an exercise cycle 412 is schematically illustrated. In this embodiment, a user may access a server-side interface 414 directly from exercise cycle 412 (e.g., using a control panel), from a personal computer 416, or from exercise cycle 412 via personal computer 416. Connection between server-side system 414 and exercise cycle 412 and/or personal computer 416 can be achieve via a network as described herein. In this embodiment, server-side interface 414 may be a website, while a network for accessing the website is the Internet. Once a connection has been established with server-side interface 414 and the user has indicated that he/she would like to create exercise programming, the user may define a remote, real world exercise route by entering a starting point, an ending point, and/or one or more intermediate points. Such information may be entered and provided to an exercise program generator 415*a* or 415*b*, which may be integral with the server-side interface 414, or external thereto. With the remote, real world exercise route defined by the starting point, ending point, and/or one or more intermediate points, exercise program generator 415*a*, 415*b* accesses one or more internal databases, third parties 20 (FIG. 1), or other sources to retrieve data relating to one or more characteristics of the defined remote, real world exercise route. Exercise program generator 415*a* or 415*b* then uses the retrieved data to generate exercise programming for an exercise cycle, and provides the information to the server side interface 414, personal computer 416, and/or exercise bicycle 412.

In one embodiment, exercise program generator 415*a* or 415*b* may access MAPQUEST.COM, MAPS.GOOGLE-.COM, or GOOGLE EARTH to obtain map data, including distances, directions, and the like, relating to the defined remote, real world exercise route. Exercise program generator 415*a* or 415*b* may also access a database, such as the GTOPO 30 database, that stores topographical data relating to the defined remote, real world exercise route. Exercise program generator 415*a* or 415*b* can use the map data and topographical data retrieved from such third parties to generate control signals that will cause an exercise cycle to simulate the terrain of the remote, real world exercise route. In addition, exercise program generator 415*a* or 415*b* may access a database, such as the GOOGLE STREET VIEW database, to retrieve a plurality of sequential static images of the remote, real world exercise route.

With the control signals generated from the topographical data and the images of the remote, real world exercise route, exercise program generator 415*a* or 415*b* generates exercise programming for an exercise cycle as described above. Server side interface 414 may then retrieve the program and communicate the exercise programming to exercise cycle 412 as shown in FIG. 9. In some embodiments, server-side interface 414 communicates the exercise programming directly to exercise cycle 412, as shown in FIG. 9. For example, when exercise cycle 412 is adapted to communicate directly with a network, server-side interface 414 can send the exercise programming directly to exercise cycle 412 via the network.

In other embodiments, server-side interface 414 communicates the exercise programming to exercise cycle 412 via personal computer 416. For instance, when personal computer 416 is adapted to communicate with a network and exercise cycle 412, via a hardwire or wireless connection, server-side interface 414 can send the exercise programming to personal computer 416, which can in turn send the exercise programming to exercise cycle 412. Personal computer 416 can send the exercise programming to exercise cycle 412 through a variety of means. For example, personal computer 416 can communicate with exercise cycle 412 via a hardwired or wireless connection as described herein. Alternatively, personal computer 416 may be adapted to store the exercise programming on a portable memory device 417, which can be selectively associated with exercise cycle 412. By way of non-limiting example, personal computer 416 can be adapted to receive and store the exercise programming on a portable memory device, such as an SD card, a DataFlash card, a MultiMedia Card (MMC), CompactFlash card, a removable NAND-type flash memory (e.g. SmartMedia, Sony Memory Stick), a one-time-programmable memory cards (OTP), XD cards, USB compatible flash memory devices, and the like. The portable memory device can then be removed from personal computer 416 and inserted or otherwise associated with exercise cycle 412.

Once the exercise programming has been delivered to exercise cycle 412 via any suitable means, such as those described herein, exercise cycle 412 can run/execute the exercise programming by processing the control signals, the display programming, and/or the audio programming. As exercise cycle 412 runs the exercise programming, exercise cycle 412 simulates the remote, real world exercise route. In particular, the control signals of the exercise programming cause exercise cycle 412 to adjust one or more operating parameters, such as the vertical or lateral incline or tilt of exercise bicycle 412 or the resistance to a flywheel or pedal assembly thereof, to replicate the terrain of the remote, real world exercise route. In addition, exercise cycle 412 can display a plurality of sequential static images of the remote, real world exercise route. As noted herein, the generation of the exercise programming can include the synchronization of the control signals and the plurality of sequential static images. This synchronization allows the user to view the images of the remote, real world exercise route while exercise cycle 412 simulates the terrain of the remote, real world exercise route that is associated with those images. In other words, synchronizing the control signals and the plurality of sequential static images allows a user of exercise cycle 412 to experience the terrain, or an approximation, of the remote, real world exercise route while simultaneously viewing images of the portion of the remote, real world exercise route that is being simulated at that time.

Thus, in one embodiment, i) topographical data retrieved from a third party such as the GTOPO 30 databases, or from another internal or external source, is used to generate control signals that adjust operational parameters of exercise cycle 412 to simulate real world terrain; and ii) image data retrieved from the same or another third party, such as the GOOGLE STREET VIEW database or another internal or external source, is synchronized with the control signals and displayed on a visual output device. In this embodiment, the user can experience the topographical changes of the real world terrain as represented by the topographical data retrieved from the GTOPO 30 database, for example, while simultaneously viewing the corresponding images for the same terrain that have been retrieved from the GOOGLE STREET VIEW database, for example.

INDUSTRIAL APPLICABILITY

In general, embodiments of the present disclosure relate to exercise cycles that can have an adjustable incline in horizontal and/or lateral directions and/or to systems that can simulate real-world terrain in an automatic and/or dynamic manner. For instance, an exercise cycle may have an adjustable incline mechanism for allowing the bike to have a forward incline simulating a descent down a hill, or a rear incline to simulate an ascent up a hill. Similar mechanisms may be employed to allow a side tilt to simulate a bike turning around a corner.

While exercise cycles generally have allowed changes in resistance to attempt to simulate the difficulty associated with an ascent, exercise cycles have generally failed to provide the realism of an actual ride. For instance, such bicycles can adjust resistance for an ascent, but merely release or reduce the resistance during other intervals, which may not correspond to a downhill portion of a ride in which a user may actually gain speed while not applying a manual force. Such resistance may be applied to a flywheel, pedal assembly, or other location on the exercise cycle.

Embodiments of the present disclosure allow a realistic experience in a number of ways. For instance, in addition to applying a resistance representative of an increase of difficulty associated with a climb up a hill, the exercise cycle may adjust its actual tilt to simulate the climb. Thus, a user not only feels an increased resistance, but also feels the actual gravitational effects of a change in vertical pitch. Similarly, for a downhill portion of an exercise program, the resistance may be reduced or eliminated, and in some embodiments may even have a negative resistance applied that tends to cause the flywheel and/or pedals to rotate even in the absence of a user applying manual force. For instance, the negative resistance may be applied at the crankshaft of a pedal assembly, at the axis of the flywheel, at the outer rim of the flywheel, directly to the belt or chain, or in any other suitable location. Thus, as with a downhill descent in on real-world terrain, the user can coast and pick up speed. In such an embodiment, or even in the absence of a cycle applying a negative resistance, the cycle may be able to change pitch to provide the gravitational aspects associated with a true descent, as the front of the bike dives downward to simulate the descent.

To give an even more realistic view of the real-world terrain, some embodiments may include a visual and/or audio output device that associates visual and/or audio output with the control signals that cause changes in the operating parameters of the exercise cycle. Street, map, satellite, birds-eye, or other views may be used to give a realistic view of the actual portion of a real-world route that a user is simulating. Sounds, instructions, and other information may be included in audio information to further enhance the user's motivation to continue an exercise program.

Further, the disclosed systems provide virtual travel throughout the world, complete with actual changes in topography and terrain. In accordance with aspects herein, a user can load or even create an exercise program based on the landscape of virtually any location in the world. By inputting a location and details about a desired program, a program can automatically be created to dynamically control the exercise cycle while also providing a realistic simulation of the actual difficulty and length of the selected route.

What is claimed is:

1. An exercise bicycle, comprising:

a bicycle frame having a support base configured to rest upon a support surface and a generally upright support structure pivotally coupled to the support base;

a pedal assembly rotatably connected to the bicycle frame;

a resistance assembly that selectively applies resistance to rotation of the pedal assembly, the resistance assembly comprising:

a flywheel operatively linked to the pedal assembly;

a resistance mechanism associated with the flywheel, the resistance mechanism being responsive to electrical control signals, wherein, in response to the electrical control signals, the resistance mechanism selectively applies a positive resistance to the flywheel, wherein the positive resistance resists rotation of the pedal assembly in a first direction; and an electric motor directly coupled to the pedal assembly, wherein the electric motor selectively applies a negative resistance to the pedal assembly, wherein the negative resistance applies a rotation force to the pedal assembly that assists rotation of the pedal assembly in the first direction, wherein the resistance mechanism and the electric motor are configured to selectively apply the positive resistance and the negative resistance simultaneously during a first state and to selectively apply the positive resistance and the negative resistance exclusive of one other during other states; and an incline mechanism connected between the support base and the generally upright support structure, the incline mechanism being responsive to electrical control signals, wherein, in response to the electrical control signals, the incline mechanism actively pivots the generally upright support structure forward and backward to change a vertical pitch of the generally upright support structure relative to the support surface, wherein contraction of the incline mechanism lowers a rear portion of the generally upright support structure vertically lower than a forward portion of the generally upright support structure, thereby causing the generally upright support structure to tilt backward to substantially simulate ascending a hill, and wherein extension of the incline mechanism raises the rearward portion of the generally upright support structure vertically higher than the forward portion, thereby causing the generally upright support structure to tilt forward to substantially simulate descending a hill;

wherein the electric motor applies the negative resistance when the generally upright support structure is tilted to substantially simulate descending a hill, and removes the negative resistance when the generally upright support structure is tilted to substantially simulate ascending a hill.

2. The exercise bicycle of claim 1, further comprising a communication interface, wherein the communication interface is configured to use exercise programming to automatically control at least one of the resistance assembly or the incline mechanism.

3. The exercise bicycle of claim 2, wherein the exercise programming includes real-world exercise programming.

4. The exercise bicycle of claim 3, wherein the real-world exercise programming is based on a real-world exercise route, and wherein the communication interface is configured to control at least one of the resistance assembly or the incline mechanism responsive to the real-world exercise route.

5. The exercise bicycle of claim 1, wherein the resistance mechanism comprises a brake that applies the positive resistance.

6. The exercise bicycle of claim 5, further comprising:

a communication interface connected to the resistance assembly and the incline mechanism, the communication interface being configured to substantially simulate terrain of a real-world exercise route by controlling the resistance assembly and the incline mechanism based on the terrain of the real-world exercise route; and programming presentation means for presenting at least a portion of the exercise programming as at least one of route information, an image, a video, or audio.

7. The exercise bicycle of claim 6, wherein the resistance assembly and incline mechanism are adjustable between multiple states, wherein the multiple states include at least:

a first state, wherein in the first state, the incline mechanism causes the bicycle frame to be at an incline substantially simulating a climb in the real-world exercise route, wherein in the first state, the pedal assembly has at least a positive resistance applied thereto by the resistance mechanism, the positive resistance resisting rotation of the pedal assembly in the first direction; and a second state, wherein in the second state, the incline mechanism causes the bicycle frame to be at an incline substantially simulating a descent in the real-world exercise route, wherein in the second state, the pedal assembly has at least a negative resistance applied thereto by the electric motor, the negative resistance facilitating rotation of the pedal assembly in the first direction.

8. The exercise bicycle of claim 1, wherein the pedal assembly comprises a pair of cranks and a crankshaft extending therebetween.

9. The exercise bicycle of claim 8, wherein the electric motor is connected to the crankshaft.

10. The exercise bicycle of claim 1, wherein the negative resistance to be applied is determined by multiplying a constant force by an incline value, and subtracting a friction factor.

11. The exercise bicycle of claim 10, wherein the constant force is approximately equal to the force of gravity.

12. The exercise bicycle of claim 1, wherein at least the incline mechanism is configured to be automatically controlled based on a combination of one or more of map data, topographical data, video data, or image data.

13. The exercise bicycle of claim 1, further comprising:

a lateral tilt mechanism coupled to at least a portion of the bicycle frame, the lateral tilt mechanism being configured to change a lateral pitch of at least a portion of the bicycle frame relative to the support surface.

14. An interactive exercise bicycle, comprising:

a bicycle frame having a support base configured to rest upon a support surface and a generally upright support structure pivotally coupled to the support base at a pivot, wherein the generally upright support structure comprises a first support member having a seat and a second support member having a handlebar assembly;

a pedal assembly connected to the bicycle frame, the pedal assembly being rotatable in a first direction;

a resistance assembly operatively associated with the pedal assembly and that selectively applies resistance to rotation of the pedal assembly, wherein the resistance assembly comprises:

a flywheel operatively linked to the pedal assembly;

a first resistance mechanism associated with the flywheel, the first resistance mechanism being responsive to electrical control signals, wherein, in response to the electrical control signals, the first resistance mechanism selectively applies a positive resistance to the flywheel, wherein the positive resistance resists rotation of the pedal assembly in the first direction; and a second resistance mechanism directly coupled to the pedal assembly, wherein the second resistance mechanism selectively applies a negative resistance to the pedal assembly in the form of a rotation force on the pedal assembly that assists rotation of the pedal assembly in the first direction, wherein the first resistance mechanism and the second resistance mechanism are configured to selectively apply the positive resistance and the negative resistance simultaneously during a first operative state and to selectively apply the positive resistance and the negative resistance exclusive of one other during other operative states;

an incline mechanism configured to selectively vary a pitch of at least a portion of the generally upright support structure relative to the support surface, the incline mechanism being connected between the support base and the first support member, the incline mechanism being responsive to electrical control signals to selectively vary the pitch of the generally upright support structure, wherein extension of the incline mechanism selectively varies the pitch of the generally upright support structure by actively pivoting the generally upright support structure about the pivot so that the seat is positioned vertically higher than the handlebar assembly to substantially simulate descending a hill, and wherein contraction of the incline mechanism selectively varies the pitch of the generally upright support structure by actively pivoting the generally upright support structure about the pivot so that the handlebar assembly is positioned vertically higher than the seat to substantially simulate ascending a hill, wherein the incline mechanism actively pivots the generally upright support structure about the pivot by applying a force between the base support and the generally upright support structure that pushes or pulls on the generally upright support structure; and a simulation system configured to substantially simulate a real-world exercise route by adjusting operating parameters of at least the incline mechanism, the simulation system being configured to provide control signals to the incline mechanism to vary the operating parameters of the incline mechanism, the control signals being representative of changes to at least one of the vertical pitch or lateral pitch of the bicycle frame relative to the support surface;

wherein the second resistance mechanism applies the negative resistance when the seat is positioned vertically higher than the handlebar assembly to substantially simulate descending a hill, and removes the negative resistance when the handlebar assembly is positioned vertically higher than the seat to substantially simulate ascending a hill.

15. The interactive exercise bicycle recited in claim 14, wherein the resistance assembly dynamically adjusts a difficulty in rotating the pedal assembly based at least in part on the real-world exercise route.

16. The interactive exercise bicycle recited in claim 15, wherein the incline mechanism is configured to substantially simulate a descent by adjusting a vertical pitch of the bicycle frame relative to the support surface, and wherein the resistance assembly is configured to apply a positive force as a negative resistance while the incline mechanism substantially simulates a descent.

17. The interactive exercise bicycle recited in claim 16, further comprising:

at least one sensor configured to detect the presence of a user, where the sensor is communicatively coupled to at least the resistance mechanism and configured to control application of the positive force when the user is not present.

18. The interactive exercise bicycle recited in claim 14, wherein the pedal assembly comprises a pair of cranks and a crankshaft extending therebetween.

19. The interactive exercise bicycle recited in claim 18, wherein the second resistance mechanism includes an electric motor connected to the crankshaft.

20. An exercise bicycle, comprising:

a bicycle frame having a support base configured to rest upon a support surface and a generally upright support structure pivotally coupled to the support base at a pivot, wherein the generally upright support structure comprises a first support member having a seat and a second support member having a handlebar assembly;

a pedal assembly connected to the bicycle frame, the pedal assembly being rotatable in a first direction, the pedal assembly comprises a pair of cranks and a crankshaft extending therebetween;

means for obtaining electrical control signals representative of real-world exercise route information;

means for varying a pitch of at least a portion of the bicycle frame relative to the support surface and responsive to the obtained electrical control signals representative of the real-world exercise route information, wherein the means for selectively varying a pitch selectively varies the pitch of the generally upright support structure by actively pushing or pulling on the generally upright support structure to pivot the generally upright support structure about the pivot so that the seat is positioned vertically lower than the handlebar assembly to substantially simulate ascending a hill and by actively pushing or pulling on the generally upright support structure to pivot the generally upright support structure about the pivot so that the handlebar assembly is positioned vertically lower than the seat to substantially simulate descending a hill;

a resistance assembly operatively associated with the pedal assembly and that selectively applies resistance to rotation of the pedal assembly, wherein the resistance assembly comprises:

a flywheel operatively linked to the pedal assembly;

a brake that selectively applies a positive resistance to the flywheel, wherein the positive resistance resists rotation of the pedal assembly in the first direction; and an electric motor coupled directly to the crankshaft of the pedal assembly, wherein the electric motor selectively applies a negative resistance to the pedal assembly in the form of a rotation force on the pedal assembly that assists rotation of the pedal assembly in the first direction, wherein the negative resistance is calculated by multiplying a gravitational force value by an incline value, wherein the incline value is associated with the pitch of the bicycle frame, wherein the brake and the electric motor are configured to selectively apply the positive resistance and the negative resistance simultaneously during a first operative state and to selectively apply the positive resistance and the negative resistance exclusive of one other during other operative states;

wherein the electric motor applies the negative resistance when the handlebar assembly is positioned vertically lower than the seat to substantially simulate descending a hill, and removes the negative resistance when the seat is positioned vertically lower than the handlebar assembly to substantially simulate ascending a hill.

* * * * *